US008142570B1

(12) United States Patent
Saaski et al.

(10) Patent No.: US 8,142,570 B1
(45) Date of Patent: Mar. 27, 2012

(54) EXTRACTION DEVICE AND METHODS

(75) Inventors: Elric W. Saaski, Bothell, WA (US); Duane M. Fox, Snohomish, WA (US)

(73) Assignee: Research International, Inc., Monroe, WA (US)

( * ) Notice: Subject to any disclaimer, the term of this patent is extended or adjusted under 35 U.S.C. 154(b) by 0 days.

(21) Appl. No.: 13/200,276

(22) Filed: Sep. 22, 2011

Related U.S. Application Data

(62) Division of application No. 12/286,029, filed on Sep. 26, 2008, now Pat. No. 8,057,608.

(51) Int. Cl.
*B08B 3/10* (2006.01)

(52) U.S. Cl. ..... 134/16; 134/10; 134/34

(58) Field of Classification Search ..... None
See application file for complete search history.

(56) References Cited

U.S. PATENT DOCUMENTS

| | | | | |
|---|---|---|---|---|
| 4,432,777 | A | 2/1984 | Postma | |
| 4,500,435 | A | 2/1985 | Muller | |
| 4,753,257 | A * | 6/1988 | Gabriel et al. | 134/184 |
| 4,808,234 | A | 2/1989 | McKay et al. | |
| 5,244,585 | A | 9/1993 | Sugimoto | |
| 5,358,552 | A | 10/1994 | Seibert et al. | |
| 6,641,646 | B2 | 11/2003 | Rosenberg | |
| 6,783,574 | B1 | 8/2004 | Angadjivand et al. | |
| 7,243,560 | B2 | 7/2007 | Coyle et al. | |
| 7,282,086 | B2 | 10/2007 | Stuckey | |
| 7,326,265 | B2 | 2/2008 | Zilliox et al. | |
| 7,387,877 | B2 | 6/2008 | Kraft | |
| 7,393,387 | B1 | 7/2008 | Heisey | |
| 7,468,085 | B2 | 12/2008 | Goddard | |
| 2004/0002126 | A1 | 1/2004 | Houde et al. | |
| 2004/0185554 | A1 | 9/2004 | Daitch et al. | |
| 2005/0260569 | A1 | 11/2005 | Houde et al. | |

OTHER PUBLICATIONS

Notice of Allowability, 6 pages, from parent U.S. Appl. No. 12/286,029, filed Sep. 26, 2008, dated Aug. 25, 2011.

* cited by examiner

*Primary Examiner* — Michael Kornakov
*Assistant Examiner* — Ryan Coleman
(74) *Attorney, Agent, or Firm* — Gregory W. Moravan

(57) ABSTRACT

An extraction device for a filter element containing collected particles of target material and an extraction fluid, wherein the device may have a piston and a vibration apparatus for vibrating the filter element to cause particles to move from the filter element and into the extraction fluid. The piston may first create compressed air to urge a first amount of extraction fluid and particles out of the filter element, and may then compress the filter element to urge a second amount of extraction fluid and particles out of the filter element.

26 Claims, 11 Drawing Sheets

EXTRACTION DEVICE AND METHODS

CROSS-REFERENCE TO RELATED APPLICATIONS

This application is a divisional of U.S. patent application Ser. No. 12/286,029 filed Sep. 26, 2008 now U.S. Pat. No. 8,057,608.

Under 37 C.F.R. 1.57 the forgoing application Ser. No. 12/286,029 is hereby incorporated by reference in this divisional application.

STATEMENT REGARDING FEDERALLY SPONSORED RESEARCH OR DEVELOPMENT

The invention was not made by an agency of the United States Government or under a contract with an agency of the United States Government.

DETAILED DESCRIPTION OF THE INVENTION

Background

Figure 1:
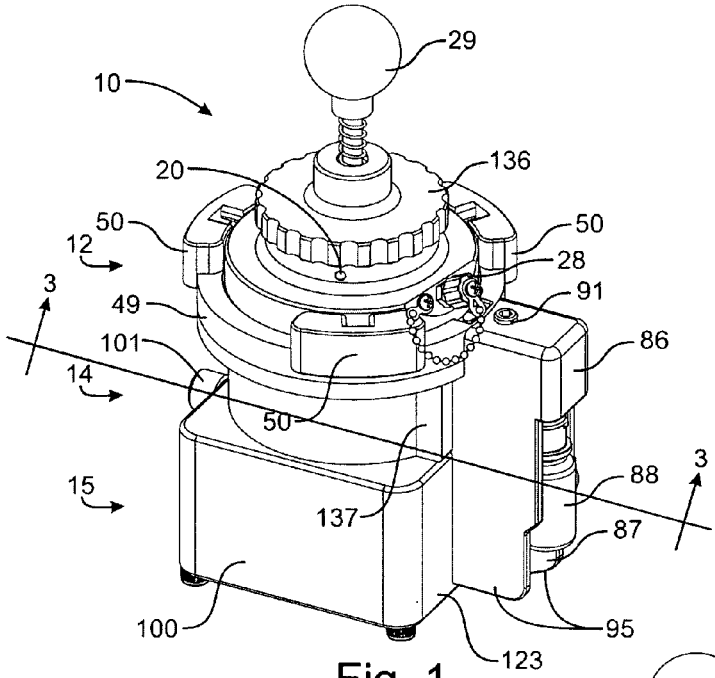
FIG. 1 is a perspective view of one side of the extraction device 10, taken from an upper aspect.
Figure 2:
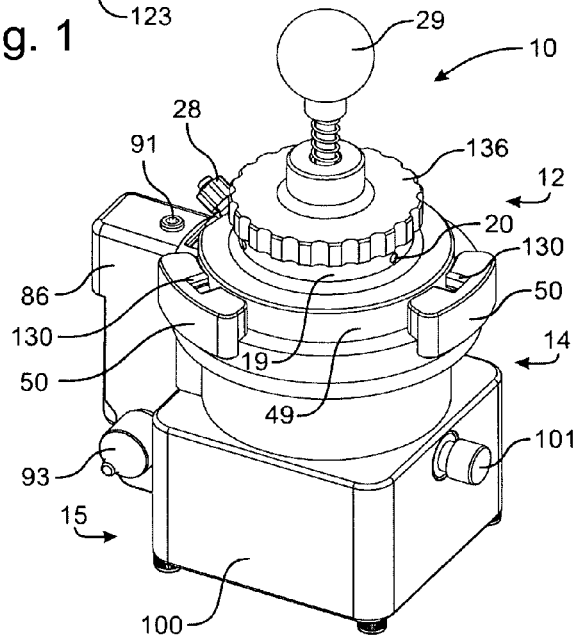
FIG. 2 is a perspective view of the other side of the extraction device 10, taken from an upper aspect.

There are many situations in which it is important that airborne particles of interest be collected (i.e., removed) from sampled air by any suitable air sampler, particle detector or analytical device. For example, in public health, airborne particles of interest may comprise pathogenic bacteria or viruses; in an agricultural context, the airborne particles of interest may comprise, for example, fungal rots and Newcastle disease; in a medical context the airborne particles of interest may comprise, for example, human viral and bacterial pathogens; and in a counter-terrorism context, the airborne particles of interest may comprise, for example, deadly toxins or biological agents.

The airborne particles of interest may be called particles of target material. The target material may be any material of interest, such as any liquid, solid, organic, inorganic, biological or non-biological material, or mixtures thereof.

It is understood that any particular particle of target material: (a) may be a particle made entirely of target material, or (b) may be a particle made partly of target material (e.g., it may be a particle that contains or comprises both target material and some other material). The term "air" is used broadly, so that it may be any gas or mixture of gasses other than air.

An air sampler may be any device that collects particles of target material from the sampled airflow so that the particles may be observed, tracked, monitored, identified, examined, tested or analyzed. A particle analyzer may be any device that determines the size, concentration, nature, or approximate composition (such as biological versus non-biological) of particles of target material. An analytical device may be any device that detects or identifies a constituent target material in particles of target material, such as explosives, drugs, bacteria, spores, viruses, toxins, animal and plant pathogens, and industrial chemicals.

For simplicity and clarity of understanding the extraction device 10 will be described as being used with any suitable air sampler. However, it will be understood that the same, or similar comments may apply to use of the extraction device 10 with any suitable particle detector or analytical device.

There are several different types of air samplers. One type of air sampler with which the extraction device 10 may be used may be called a "dry air sampler". A dry air sampler is one in which the sampled air flows through any suitable type of filter element 113, so that the filter element 113 may collect particles of target material from sampled air. The filter element 113 may comprise any suitable filter media, such as a perforated surface or a porous or fibrous bulk filter media.

The term "dry air sampler" may be somewhat of a misnomer, since the filter element 113 in a dry air sampler may be either dry or wet. If the filter element 113 is wet, it may be wet with oil, water, or any other suitable fluid.

Whether the filter element 113 is dry or wet, the collected particles of target material may have to be extracted from the filter element 113 for subsequent observation, tracking, monitoring, examination, testing, or analysis.

A serious problem is that some of the best filter medias for the filter element 113 are hydrophobic, as are many of the different kinds of particles of target material that may be collected. The firm attraction that exists between hydrophobic particles of target material and a hydrophobic filter media that collected them makes it quite difficult to extract such particles from such a filter media.

In addition, if the hydrophobic filter media is a bulk filter media, then the hydrophobic particles of target material that it collected must then be extracted from it, which may pose problems due to the complex and random geometry of the fibers or pores in such a filter media. Thus, in the past the extraction of collected hydrophobic particles of target material from a hydrophobic bulk filter media has generally been relatively time consuming and relatively inefficient i.e., many of the collected hydrophobic particles of target material may not be successfully extracted from such a filter media.

An example of a hydrophobic bulk filter media is an electret bulk filter media that comprises a matt of nonwoven hydrophobic electret fibers, much like a felt. In general, an electret bulk filter material is typically made from any suitable ceramic or polymer material that has been processed so that it exhibits frozen-in electrostatic fields emanating from its edges, much like the magnetic fields emanating from a permanent magnet. These electrostatic fields are particularly effective at polarizing passing particles of target material, and capturing them, because of an induced electrostatic attraction. By way of example, an electret bulk filter media may be made from polypropylene, which is a polymer material that is well known for its hydrophobic and chemical-resistant properties.

An example of an electret, hydrophobic, fibrous bulk filter media is G-100 filter media made by the 3M company of St. Paul, Minn. In its raw form, this filter media is approximately 3.3 mm thick, but it may be compressed considerably because of its very low density, i.e., about 96% of its uncompressed volume comprises air spaces between the fibers in the filter media. Even though its volumetric density is low, the electrostatic properties of its individual fibers lead to good collection rates of the particles of target material. By way of example, if a sampled airflow has a face velocity of 300 cm/sec at the airside face of such a filter media (the face of the filter media that faces the sampled airflow), its collection efficiency is about 50% when the diameter of the hydrophobic particles of target material is about 0.5 microns, and rises rapidly as the size of the particles increases.

If micron-sized hydrophobic particles of target material are collected by a filter element 113 that is made from a filter media that has the above properties, and water is then flushed through the filter element 113 to extract the collected particles, typical extraction rates might only be in the range of about 10% or less.

However, it has been discovered that the extraction device 10 may extract from at least about 60% to at least about 80%, or more, of the hydrophobic particles of target material from such a filter element 113, which is an enormous improvement. Naturally, even higher percentages of the particles of target material may be extracted if the particles and the filter element 113 are not both hydrophobic, or if the filter element is not made from an electret filter media.

Overview of the Extraction Device 10

Figure 5:
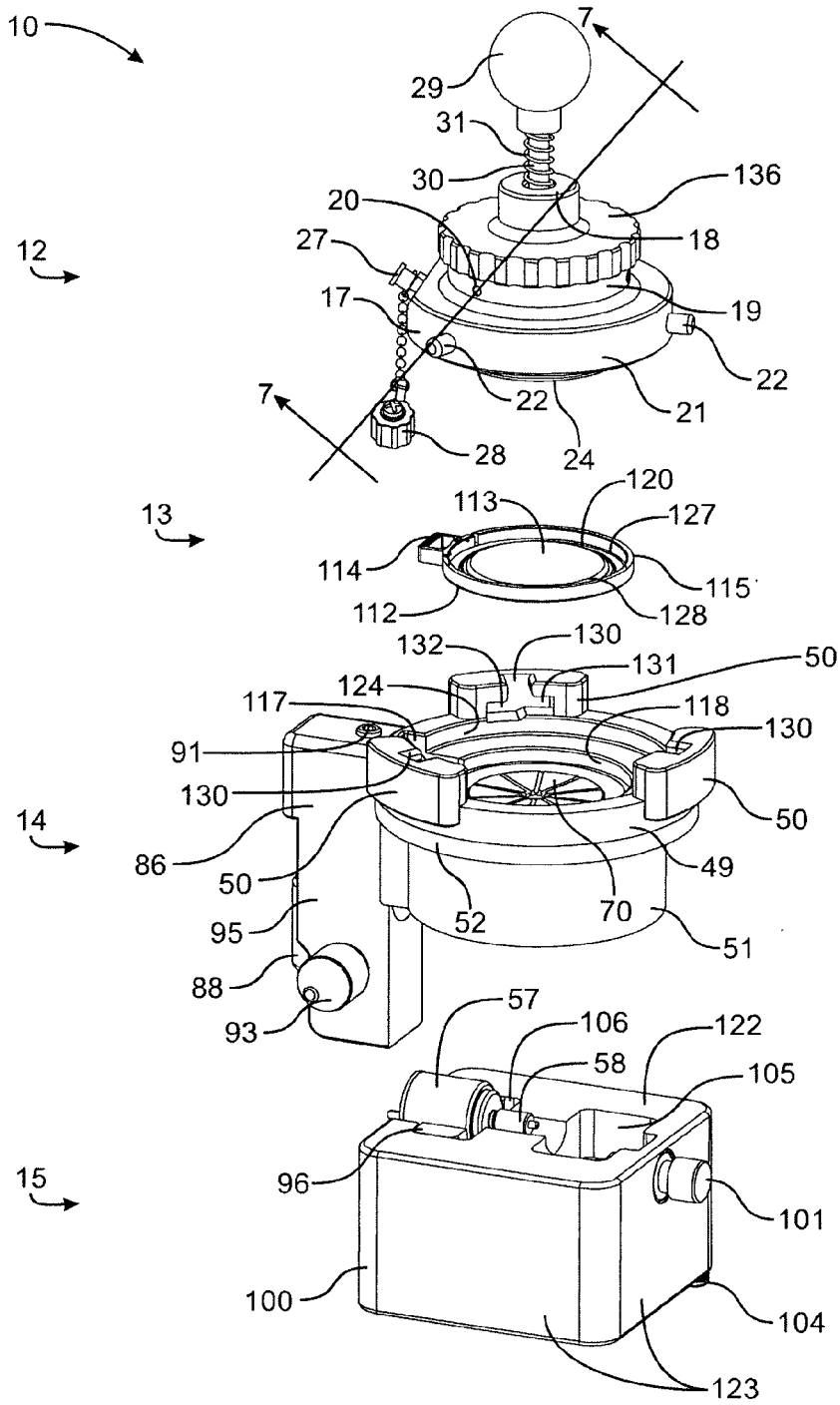
FIG. 5 is a partly exploded perspective view of the extraction device 10, taken from an upper aspect.
Figure 6:
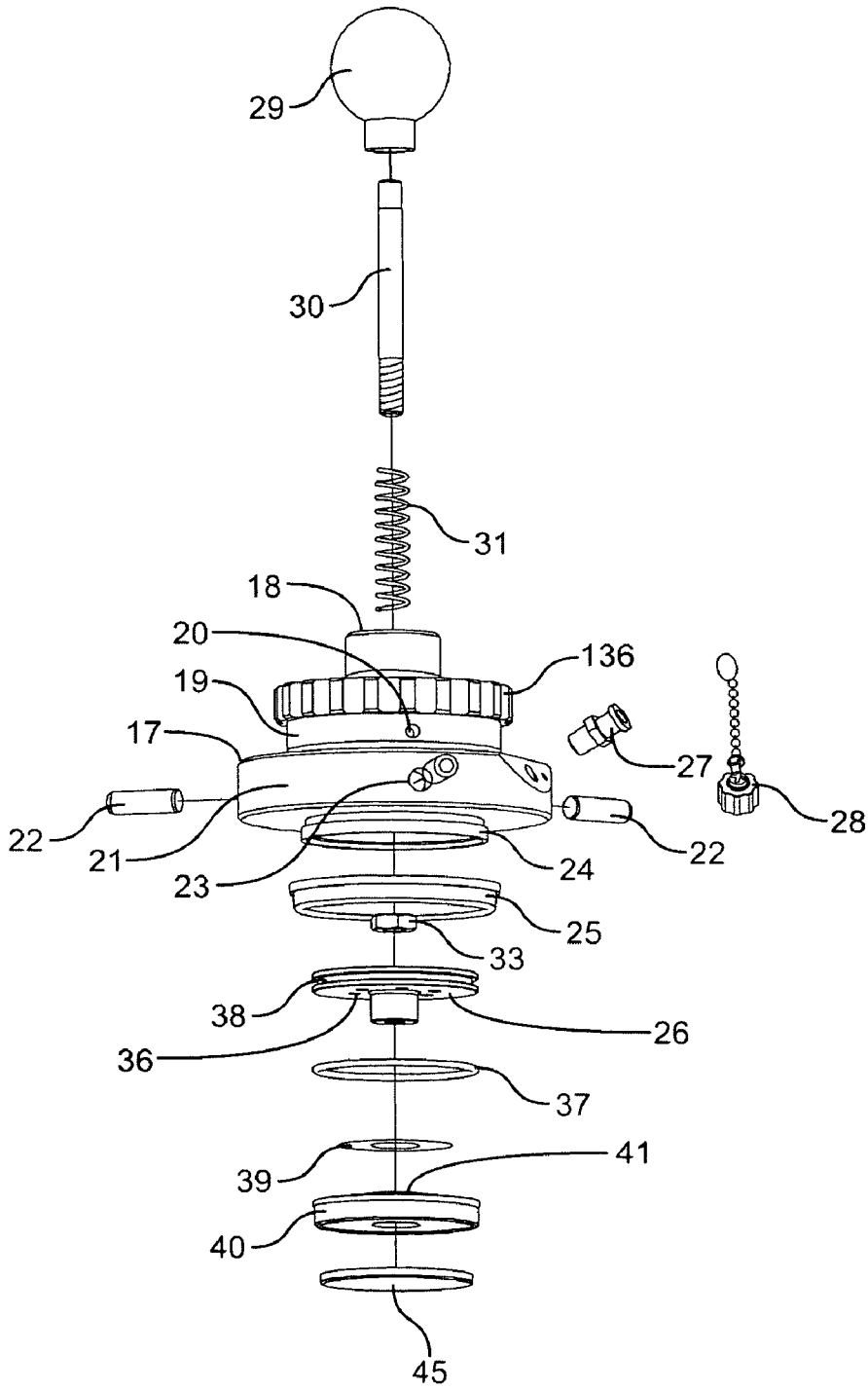
FIG. 6 is an exploded perspective view of the extraction device 10's pump cap assembly 12, taken from a lower aspect.
Figure 7:
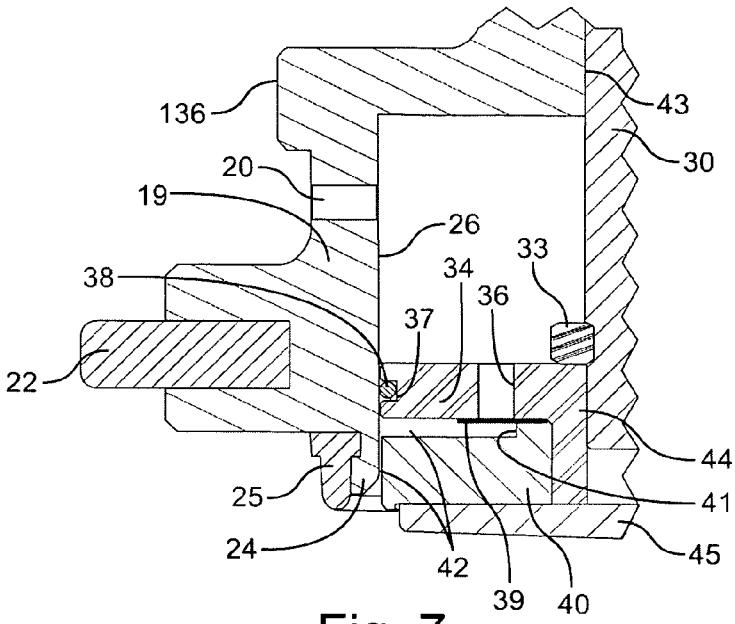
FIG. 7 is an enlarged cross-sectional view of a portion of the pump cap assembly 12, taken along line 7-7 of FIG. 6, showing the position of certain of its parts on the compression stroke of its pump piston 34.
Figure 8:
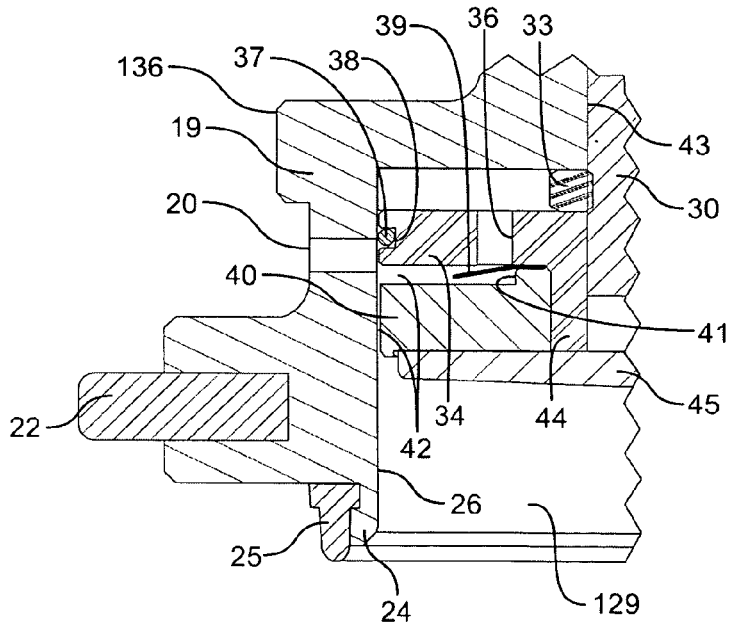
FIG. 8 is a view like that of FIG. 7, showing the position of certain of the pump cap assembly 12's parts on the return stroke of its pump piston 34.
Figure 9:
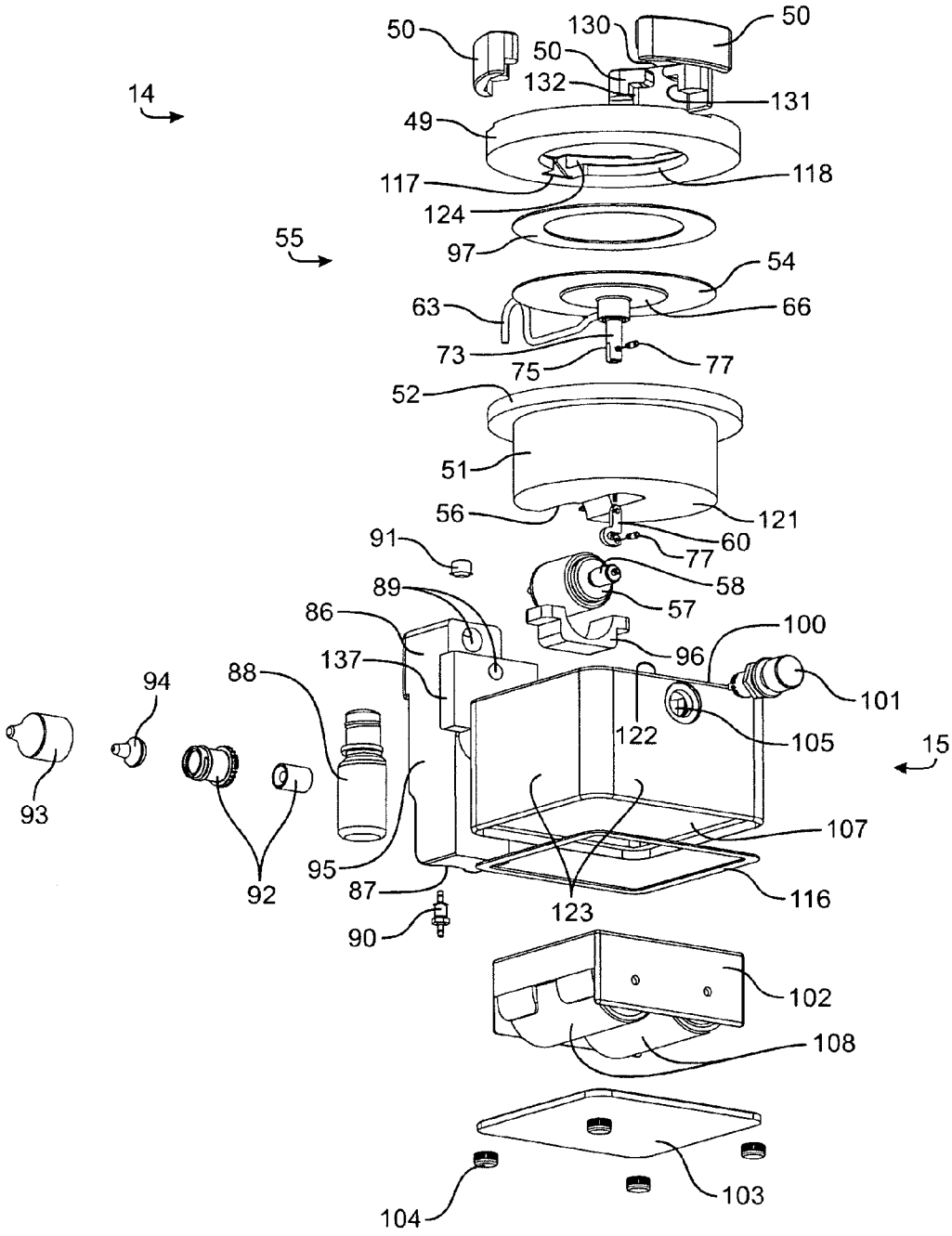
FIG. 9 is an exploded perspective view of the extraction device 10's extractor body assembly 14, battery case assembly 15 and extraction fluid bottle holder 86, taken from a lower aspect.

Turning now to the Figures, as best seen in FIG. 5 the extraction device 10 may comprise three main components, i.e., a pump cap assembly 12, an extractor body assembly 14; and a battery case 15 assembly. The pump cap assembly 12's cylinder body 19 and the extractor body assembly 14's extractor body 51 may form an extractor housing for certain of their internal components. As will be explained below, the extraction device 10 may be used to extract particles of target material from the filter element 113 of a filter cartridge 13.

The Pump Cap Assembly 12

As best seen in FIGS. 3 and 5-8, the pump cap assembly 12 may comprise a pump cap 17 having a stop 18; a cylinder body 19 having at least one vent hole 20 (four being illustrated by way of example), a flange 21, at least one locking pin 22 assembled in a respective corresponding bore 23 in the flange 21 (three each of the pins 22 and bores 23 being illustrated by way of example), and a neck 24 to which a seal 25 may be assembled. Alternatively, the at least one locking pin 22 may be carried by the extractor body 51.

The pump cap assembly 12 may further comprise a pump handle 29; a pump shaft 30; a pump return spring 31; a spring recess 32 in the stop 18 for receiving one end of the spring 31; a piston travel adjusting nut 33 on the pump shaft 30; and a pump piston 34. The cylinder body 19, flange 21 and neck 24 may define a cylinder 26.

An extraction chamber 129 may be formed by the portion of the cylinder 26 that is located between the pump piston 34 and the piston 55 in the extractor body 51. The pump piston 34 may travel up and down in the extraction chamber 129. The size of the extraction chamber 129 will vary, being at a minimum when the piston 34 has reached the end of its compression stroke, and being at a maximum when the piston has reached the end of its return stroke. The extraction fluid discharge bore 69 in the piston 55 may serve to convey particle-laden extraction fluid out of the extraction chamber 129. A particle-laden extraction fluid is an extraction fluid that carries particles of target material that have been extracted from the filter element 113 by the extraction device 10.

The pump cap 17 may also have a Luer fitting 27, a sealable cap 28 for the Luer fitting 27, and a bore 46 in its flange 21 into which the Luer fitting 27 may be assembled. The Luer fitting 27 and its bore 46 may be in fluid communication with the extraction chamber 129. Together, the Luer fitting 27, its cap 28 and its bore 46 may form a selectively sealable entry port that is operable to permit extraction fluid to be added to the extraction chamber 129, and thus to the filter element 113.

Alternatively, the Luer fitting 27, its cap 28 and its bore 46 may be eliminated, in which case the desired amount of extraction fluid may be added to the extraction chamber 129 and filter element 113 before the pump cap assembly 12 and extractor body assembly 14 are assembled together.

The Pump Piston 34

As best seen in FIGS. 3 and 6-8, the pump piston 34 may comprise at least one valve port 36 (six ports 36 being illustrated by way of example); and an O-ring 37 that may be assembled in a peripheral recess 38 in the piston 34. The piston 34 may further comprise a valve membrane 39 that may be assembled to a lower neck 44 of the piston 34; a valve membrane holder 40 that may also be assembled to the lower neck 44 and that may hold the valve membrane 39 in place; and a filter compression pad 45.

The valve membrane 39 and valve ports 36 may form an air pressure actuated one-way valve that closes on the piston 34's compression stroke (downstroke), so that the air beneath the piston 34 may be compressed, and that opens on the return stroke (upstroke) of the piston 34 to admit air into the extraction chamber 129 between the piston 34 and the filter element 113, so that the piston 34 will not suck the extraction fluid back into the filter element 113 via the fluid discharge tube 63 and discharge bore 69.

When the pump cap assembly 12 is assembled, the O-ring 37 may provide a fluid-tight seal between the piston 34 and the piston cylinder 26. The term "fluid-tight seal" is broadly used herein, to encompass both gas-tight and liquid-tight seals.

The holder 40 may have a spacing neck 41 on its upper surface to provide an airflow space 42 between it and the bottom of the piston 34. The airflow space 42 may also extend between the periphery of the holder 40 and the inside of the cylinder 26. The spacing neck 41 may serve a dual purpose, in that it may also hold a central portion of the valve membrane 39 sandwiched with a fluid-tight seal between it and the lower surface of the piston 34. The holder 40 may have a diameter that is smaller than the diameter of the cylinder 26, in order to provide a part of the airflow space 42 that permits airflow past the periphery of the holder 40 on the return stroke of the piston 34. A resilient filter compression pad 45 may be assembled to the lower surface of the holder 40.

Assembly of the Pump Cap Assembly 12

In order to assemble the pump cap assembly 12, the locking pins 22 may be inserted and secured in their respective bores 23 in the flange 21; the seal 25 may be assembled to the neck 24; the Luer fitting 27 may be assembled in its bore 46 in the flange 21; and the cap 28 may be assembled to the Luer fitting 27.

The pump handle 29 may be assembled to the upper end of the pump shaft 30, and the shaft 30 may be inserted through the pump return spring 31 and through the pump shaft bore 43 in the upper end of the pump cap 17, with the lower end of the spring 31 being received in the spring recess 32.

The piston 34 may be assembled by assembling its O-ring 37 in its recess 38; assembling its valve membrane 39 over its lower neck 44; and assembling its valve membrane holder 40 to its lower neck 44, so that the holder 40's spacing neck 41 sandwiches a central portion of the valve membrane 39 between it and the lower surface of the piston 34 with a fluid-tight seal. The filter compression pad 45 may be assembled to the lower surface of the holder 45. The piston 34 may then be assembled to the lower end of the shaft 30.

The vertical distance the piston 34 may travel may be selectively adjusted by using the piston travel-adjusting nut 33.

The various parts of the pump cap assembly 12 may be assembled together in any suitable way, such as by using fasteners; interference fits; friction fits; barbed, threaded, bonded, glued or welded connections; splines; keys; or mechanical couplers.

The seal 25, O-ring 37, and filter compression pad 45 may be made from any suitable flexible or resilient material such as rubber or plastic, and the valve membrane 39 may be made from any suitable strong, flexible material such as Mylar. The various other parts of the pump cap assembly 12 may be made from any suitable strong, durable substance, such as from metal, plastic, or composite material.

The Extractor Body Assembly 14

As best seen in FIGS. 3-5 and 9, the extractor body assembly 14 may comprise a locking ring 49; a gasket 97; an extractor body 51; a piston 55; a vibration motor 57; a assembly bracket 96 for the vibration motor 57; an eccentric coupling 58; a link 60 and a pair of link pins 77 for connecting the vibration motor 57 to the piston 55; a fluid discharge tube 63, and a bottle holder 86. The vibration motor 57 may cause the piston 55 to reciprocate (i.e., vibrate).

The locking ring 49 may have at least one locking dog 50 (three being illustrated) for receiving a respective locking pin 22 of the pump cap 17; a filter handle recess 117 for receiving the handle 114 of the filter cartridge 13, a hole 118 for receiving the filter element holder 112 and filter element 113 of the filter cartridge 13, and an annular recess 124 for receiving the flange 21 of the pump cap 17. Alternatively, the at least one locking dog 50 may be carried by the pump cap 17. Preferably, there may be at least two locking dogs 50 and their respective locking pins 22, with each locking dog 50 being carried by either the locking ring 49 or the pump cap 17, and with each locking dog 50's respective locking pin 22 being carried by the other of the locking ring 49 or the pump cap 17. For example, if a particular locking dog 50 was carried by the pump cap 17, then its respective locking pin 22 would be carried by the locking ring 49.

Each locking dog 50 may be assembled to the upper surface of the locking ring 49, and may comprise a central opening 130 for removably receiving its respective locking pin 22; an extraction slot 131 for removably receiving its respective locking pin 22 when the pump cap 17 is rotated in a clockwise direction; and a decontamination slot 132 for removably receiving its respective locking pin 22 when the pump cap 17 is rotated in a counterclockwise direction.

Figure 3:
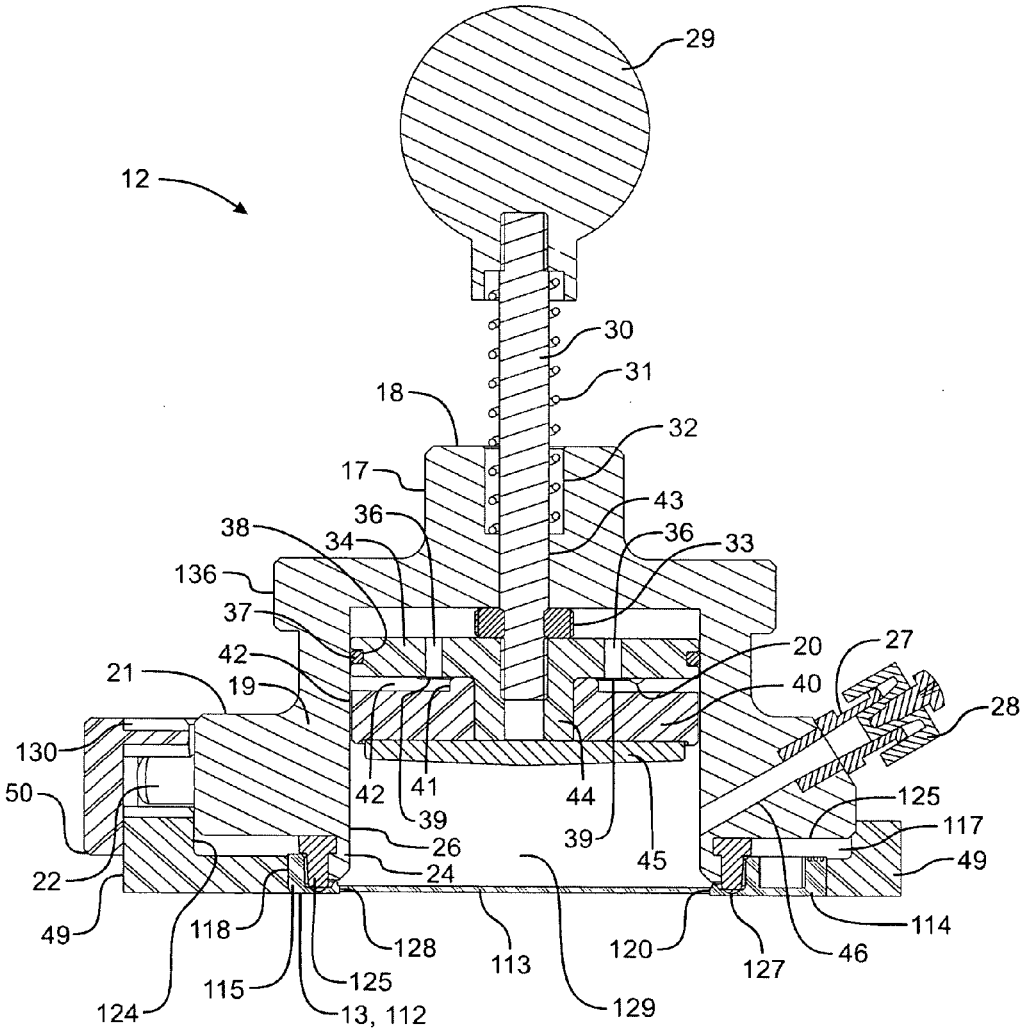
FIG. 3 is a cross-sectional view of the extraction device 10's pump cap assembly 12, locking ring 49, dogs 50, and filter cartridge 13, taken along line 3-3 of FIG. 1.

When the locking pins 22 are engaged in their respective extraction slots 131, the seal 25 of the neck 24 of the pump cap 17 will be pressed against the top surface of the annular sealing flange 127 of the filter cartridge 13's filter element holder 112, as best seen in FIG. 3. On the other hand, when the locking pins 22 are engaged in their respective decontamination slots 132, then the seal 25 will be pressed against the top surface of the diaphragm 54, since the filter cartridge 13 may removed from the extraction device 10 while it is being decontaminated, i.e., while it is being cleaned. Thus the only difference in the operation of the slots 131, 132 is that the slot 132 will bring the seal 25 closer to the top surface of the diaphragm 54 by the thickness of the sealing flange 127, as compared to the slot 131.

The extractor body 51 may have a flange 52 with an annular recess 53 for receiving the annular assembly edge 80 of the diaphragm 54 for the piston 55. The extractor body 51 may also have a cavity 98 for the upper portion of the piston 55; a recess 56 for receiving the vibration motor 57 and the eccentric coupling 58; a bore 59 for receiving the leg 73 of the piston 55; a stop 61 for neck 72 of the piston 55; and a bore 62 for the fluid discharge tube 63.

Figure 12:
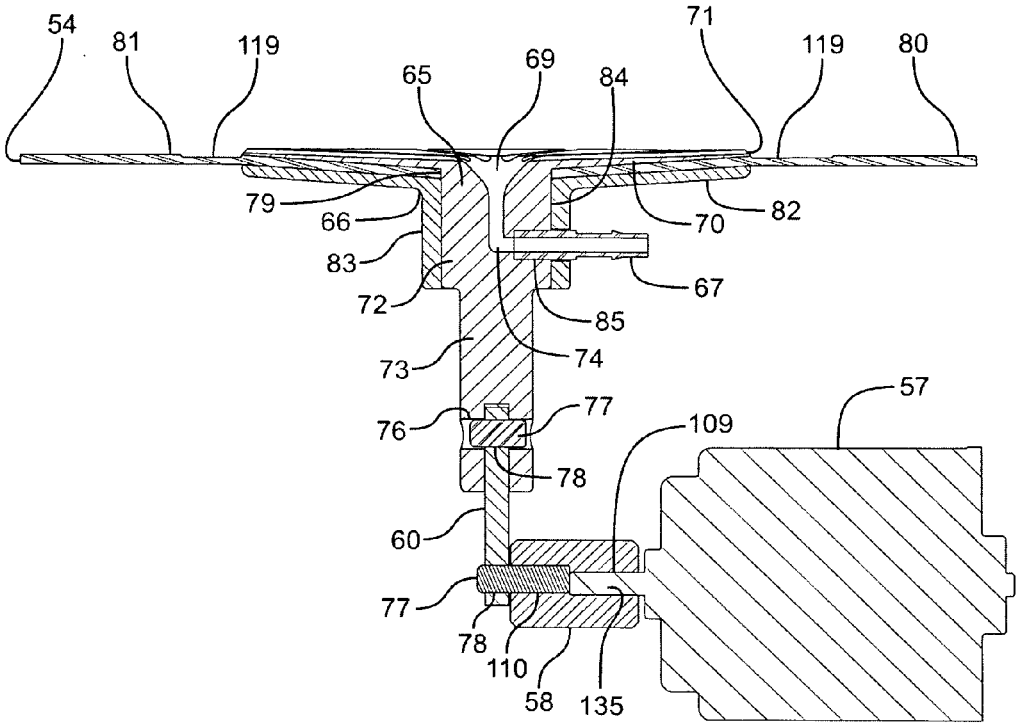
FIG. 12 is a cross-sectional view of the piston 55, taken along line 12-12 of FIG. 10.
Figure 13:
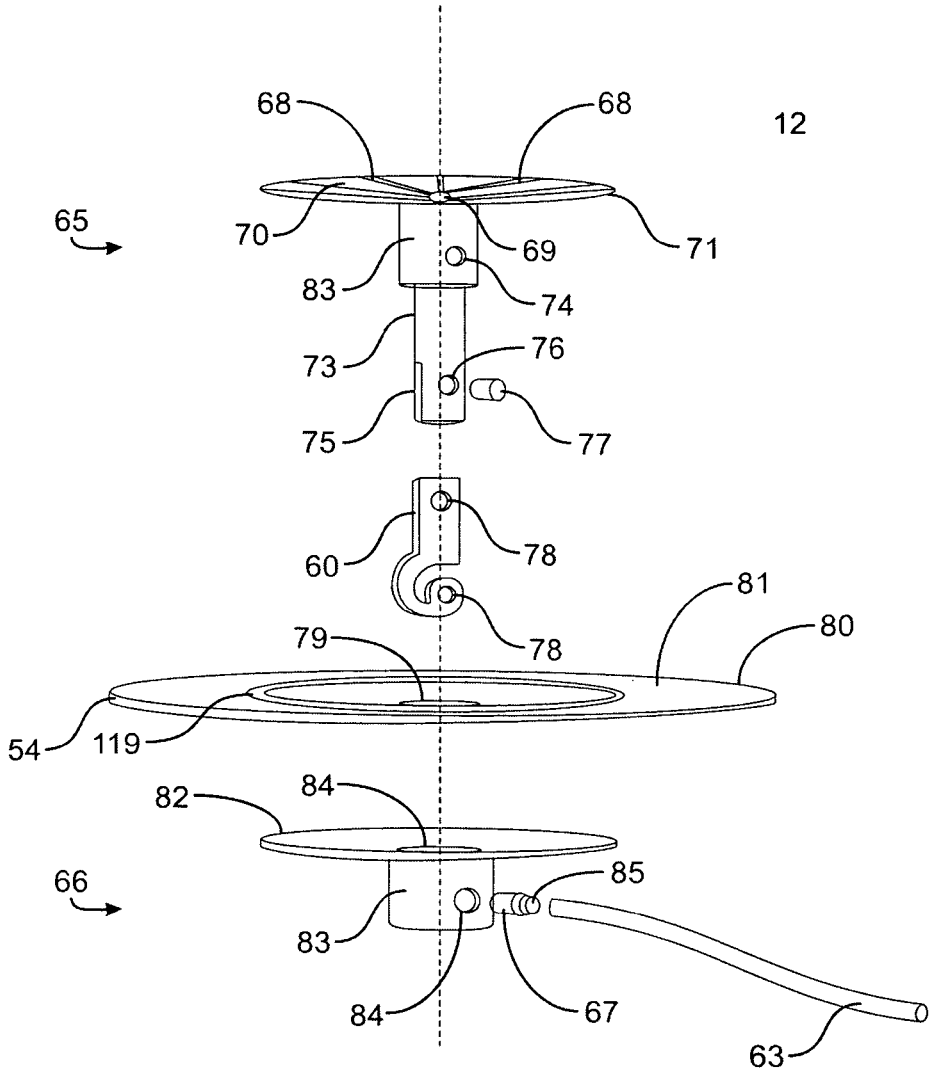
FIG. 13 is an exploded perspective view of the piston 55, taken from an upper aspect.

As best seen in FIG. 12, the link 60 may have a link pin bore 78 in each of its upper and lower ends for receiving a respective link pin 77. A first end of the eccentric coupling 58 may have an axial bore 109, while a second end of the eccentric coupling 58 may have an eccentric (i.e., a non-axial) bore 110. The circumferential offset of the eccentric bore 110 determines the effective displacement of the piston 55 while it is reciprocating.

Figure 10:
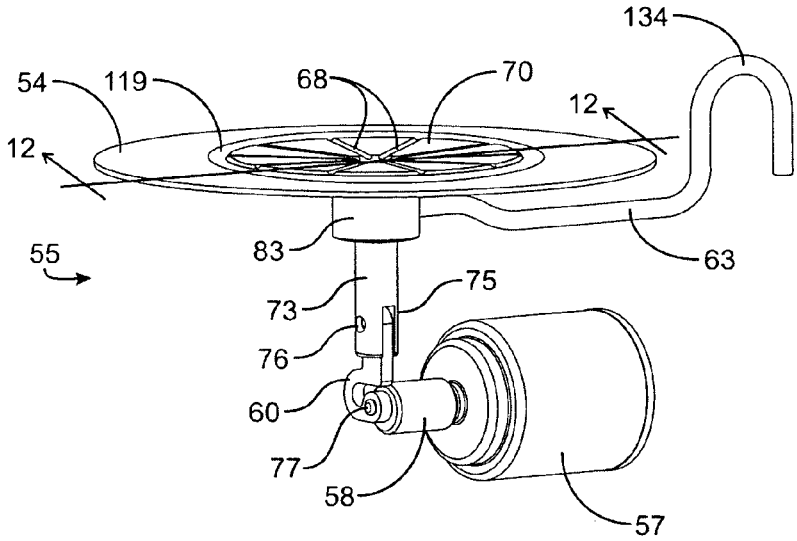
FIG. 10 is a perspective view of the extraction device 10's piston 55 and vibration motor 57, taken from an upper aspect.
Figure 11:
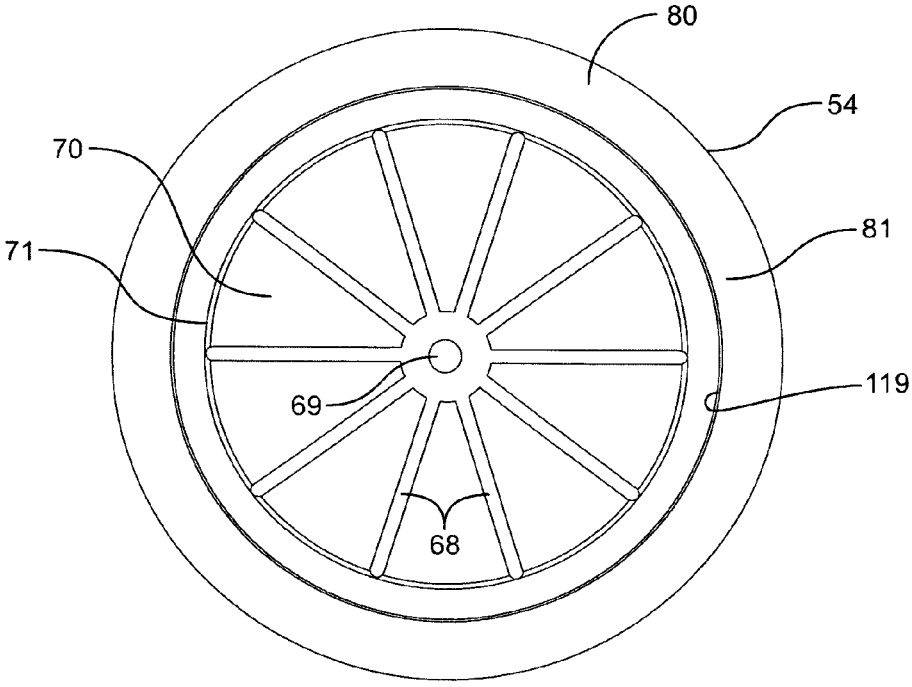
FIG. 11 is a top elevational view of the piston 55.

The link 60's central section (best seen in FIG. 10), may be relatively flexible, in order to allow it to deflect laterally somewhat when the link 60 is firmly compressed, to help prevent excessive side loading on the bearings in the motor 57 during use of the extraction device 10.

In any event, the stop 61 in the extractor body 51 stops downward travel of the piston 55 at the bottom of the compression stroke of the piston 34. This permits the filter element 113 to be firmly compressed between the piston 34's filter compression pad 45 and the top of the piston 55, thereby squeezing out of the filter element 113 at least some of the particle-laden extraction fluid. The particle-laden extraction fluid may then be conveyed through the fluid discharge grooves 68 in the top of the piston 55, and out through its fluid discharge bore 69 for collection. The bore 69 may have an inlet in the top of the piston 55, and may have an outlet 74 in the side of the piston 55 into which an outlet nipple 67 may be inserted.

The Piston 55

The piston 55 may serve one or more of the following functions: (a) acting as a filter support that may be operable to support the filter element 113 and filter element holder 112 during the compression stroke of the piston 34, and that is operable to convey the extraction fluid away from the filter element 113 and to the extraction fluid discharge tube 63; and (b) vibrating the filter element 113 and filter element holder 112. Alternatively, the piston 55 may only support the filter element 113.

As best seen in FIGS. 4 and 9-13, the piston 55 may comprise a piston head 65, a piston diaphragm 54, a piston base 66, and a nipple 67 for the discharge tube 63. The upper surface of the top plate 70 of the piston head 65 may have at least one optional fluid discharge groove 68 (ten grooves 68 being illustrated by way of example), in fluid communication with the inlet of the fluid discharge bore 69. In order to encourage the flow of fluid into the inlet of the bore 69, the top plate 70 may be concave or funnel-shaped, so that the inlet of the fluid discharge bore 69 is lower than the periphery 71 of the top plate 70. The outlet 74 of the bore 69 may be in the neck 72 of the piston head 65. The piston head 65 may also comprise a leg 73 having a slot 75 for receiving the upper end of the link 60, and a link pin bore 76 for receiving a respective link pin 77.

The diaphragm 54 may have a hole 79 through which the piston head 65's neck 72 and leg 73 may pass. The diaphragm 54 may also have an annular free portion 81 located between the piston head 65 and the diaphragm 54's annular assembly edge 80; and may further have an annular recess 119 in its upper surface for receiving the filter element holder 112. Alternatively, the recess 119 may be eliminated.

The piston base 66 may comprise a concave or funnel-shaped annular top plate 82 which may be shaped to conform to the shape of the bottom surface of the top plate 70 of the piston head 65. The piston base 66 may also comprise a neck 83 having through bore 84 for the leg 73 and neck 72 of the piston head 65, and having a fluid discharge bore 85 into which the nipple 67 may be assembled. There may be a snug friction fit or adhesive bond between the neck 72 of the piston head 65 and the bore 84.

The piston 55 may be assembled by first assembling together the piston head 65, piston diaphragm 54, and piston base 66. This may be done by passing the leg 73 and neck 74 of the piston head 65 through the hole 79 in the pump diaphragm 54 and through the bore 84 in the piston base 66 until the central portion of the diaphragm 54 is sandwiched tightly, with a fluid-tight fit, between the respective top plates 70, 82 of the piston head 65 and the piston base 66. When the piston head 65 and piston base 66 are assembled together, the fluid outlet 74 in the neck 72 of the piston head 65 is aligned with the fluid discharge bore 85 in the piston base 66. The nipple 67 for the fluid discharge tube 63 may then be assembled in its bore 85 in the neck 83 of the piston base 66, and one end of the tube 63 may be assembled to the nipple 67.

The fluid discharge tube 63 may be routed in such a manner so as to provide an air trap (i.e., a P-trap), which is positioned above the nominal fluid level in the extraction device 10 during the extraction process. The P-trap may prevent extraction fluid from flowing out of the piston 55 while the filter element 113 is being vibrated, which flow might otherwise occur due to normal gravitational or siphoning effects if there were no P-trap. It may be preferred that the extraction fluid flow into the extraction bottle 88 only occur during the compression stroke of the piston 34.

The Bottle Holder 86

As best seen in FIGS. 1, 4-5 and 9, the extraction fluid bottle holder 86 may comprise a pair of assembly flanges 137, a pair of bottle flanges 95, a bottle slot 87 located between the flanges 95 for releasably holding an extraction fluid bottle 88, a bore 89 for the fluid discharge tube 63, an outlet fitting 90, a removable access plug 91 in a hole 138 for providing access to the tube 63 in the bore 89, and a bottle cap holder 92 for holding the bottle cap 93 and the nipple 94 of the bottle 88. Alternatively, the plug 91 and its hole 138 may be omitted.

The bottle slot 87 may have an arcuate cross-sectional configuration and have no bottom. The bottle flanges 95 may be sized to releasably hold the bottle 88 in the bottle slot 87 with a sliding compression or friction fit. Such fit may be operable to hold the bottle 88 while it is slid up in the bottle slot 87 until the top of the bottle 88 is in contact with the top of the bottle slot 87, and until the outlet fitting 90 is located in the top of the bottle 88. Such fit may also be operable to permit the bottle 88 to be slid down the bottle slot 87, and out through the open bottom of the bottle slot 87, when it is desired to remove the bottle 88 after it has received extraction fluid and particles of target material from the outlet fitting 90. It is understood that the terms "up" and "down" regarding the movement of the bottle 88 in the bottle slot 87 are to be construed broadly enough to cover any back and forth movement of the bottle 88 in the bottle slot 87, regardless of the orientation of the extraction device 10.

The bottle holder 86 may be assembled by assembling its outlet fitting 90 in the outlet end of its bore 89, by assembling its bottle cap holder 92 to one of its sides, and by assembling its plug 91 in its hole 138 if a plug 91 and hole 138 are provided.

Assembly of the Extractor Body Assembly 14

The extractor body assembly 14 may be assembled by first inserting the piston 55 into the cavity 98 in the extractor body 51 until the leg 73 of the piston 55 is received in the bore 59 in the extractor body 51, and until the annular assembly edge 80 of the diaphragm 54 of the piston 55 rests in its recess 53 in the flange 52 of the extractor body 51.

The locking ring 49 may then be assembled to the flange 52, with the annular assembly edge 80 of the diaphragm 54 being sandwiched between the locking ring 49 and the flange 52, to provide a fluid-tight seal between the locking ring 49 and flange 52. An optional gasket 97 may also be sandwiched between the locking ring 49 and flange 52.

The fluid discharge tube 63 may be routed through its bore 89 in the bottle holder 86 and through the cavity 98 in the extractor body 51. If an access plug 91 and hole 138 are provided, such routing of the discharge tube 63 through its bore 89 may be assisted by removing the access plug 91 in the bottle holder 86, in order to provide access to the discharge tube 63 through the access plug 91's hole 138. After the discharge tube 63 has been routed through its bore 89, the access plug 91 may be reassembled in its hole 138. One end of the fluid discharge tube 63 may be assembled to its outlet fitting 90 in the bottle holder 86, while its other end may be assembled to its fitting 67 in the piston 55. The bottle holder 86 may be then be assembled to the extractor body 51 by using its assembly flanges 137.

A first end of the eccentric coupling 58 (which has an axial bore 109), may then be assembled to the vibration motor 57's drive shaft 135 by inserting the drive shaft 135 into the axial bore 109, while a second end of the eccentric coupling 58 (which has an eccentric bore 110), may be mounted to the lower end of the link 60 by inserting a link pin 77 that extends through the link pin bore 78 in the lower end of the link 60 and through the eccentric bore 110 in the eccentric coupling 58.

The upper end of the link 60 may be mounted to the leg 73 of the piston head 65 by inserting the upper end of the link 60 into the slot 75 in the leg 73, and by then inserting a link pin 77 that extends through the link pin bore 76 in the leg 73 and through the link pin bore 78 in the upper end of the link 60. The mounting bracket 96 may then be used to assemble the vibration motor 57 to the extractor body 51 in its recess 56.

When the electric motor 57 is turned on it rotates the eccentric coupling 58, which causes the link 60 to reciprocate. The link 60, in turn, causes a corresponding reciprocation, i.e., it causes a corresponding vibration, of the piston 55's piston head 65, which is permitted by the annular free portion 81 of the piston 55's diaphragm 54.

The frequency of the vibrations of the piston 55 and its piston head 65 may be in the range of from about 10 Hz to about 5,000 Hz, although the frequency may be higher or lower than this range. As a further alternative, the piston 55 and its piston head 65 may be caused to vibrate in any direction or combination of directions, other than just vibrating up and down.

As a further alternative, the piston 55, vibration motor 57, eccentric coupling 58, link 60, and link pins 77 may be eliminated, so that the filter element 113 and filter element holder 112 are not vibrated during use of the extraction device 10. In such a case, in lieu of the piston 55 acting as a filter support for the components 112 and 113, any other suitable filter support for the components 112 and 113 may be used that is operable to support the components 112 and 113 during the compression stroke of the piston 34, and that is operable to convey the extraction fluid away from the filter element 113 and to the extraction fluid discharge tube 63.

As another alternative, any other suitable vibration apparatus may be used to vibrate the filter element 113 or filter element holder 112 in lieu of the above described vibration apparatus that comprises a piston 55 driven by a vibration motor 57. For example, such other suitable vibration apparatus may comprise an ultrasonic vibrator, a speaker coil and magnet, a piezoelectric element, a pneumatic piston, or a hydraulic piston. As a further alternative, the piston 55 may be replaced by a vibration plate that may be, for example, sandwiched between the pump cap assembly 12 and the extractor body assembly 14. The vibration plate may be provided with a fluid discharge bore 69, and may be vibrated with any suitable vibration apparatus.

The various parts of the extractor body assembly 14 may be assembled together in any suitable way, such as by using fasteners; interference fits; friction fits; barbed, threaded, bonded, glued or welded connections; splines; keys; or mechanical couplers.

The diaphragm 54, fluid discharge tube 63 and gasket 97 may be made from any suitable flexible or resilient material such as rubber or plastic. The various other parts of the pump cap assembly 12, aside from the electric motor 57, may be made from any suitable strong, durable substance, such as from metal, plastic, or composite material.

The Battery Case Assembly 15

As best seen in FIGS. 1-2, 4-5 and 9, the battery case assembly 15 may comprise a battery case 100; an on/off switch 101 for the vibration motor 57; a battery holder 102 for batteries 108 (two batteries 108 being illustrated by way of example); a bottom cover 103; a gasket 116 and feet 104 (four feet 104 being illustrated by way of example).

The battery case 100 may have a switch chamber 105 in which the switch 101 may be received; a recess 106 for receiving the vibration motor 57, the vibration motor 57's bracket 96, and the eccentric coupling 58; and a cavity 107 in which the battery holder 102 may be assembled.

The battery case assembly 15 may be assembled by assembling the switch 101 in its switch chamber 105, by assembling the battery holder 102 in its cavity 107, by assembling the batteries 108 in the battery holder 102, by assembling the bottom cover 103 to the bottom of the battery case 100, and by assembling the feet 103 to the bottom of the bottom cover 103.

Any suitable electrical wiring may be used to electrically connect together the batteries 108, switch 101 and vibration motor 57. Since such wiring is entirely conventional and well known to those of ordinary skill in the art, it has not been illustrated in the Figures for clarity.

The Filter Cartridge 13

As best seen in FIGS. 3 and 5, the filter cartridge 13 may comprise an annular element holder 112 to which is assembled a circular filter element 113. The filter cartridge 13 may come from a dry air sampler, or from any other device using a wet or dry filter element 113 for collecting particles of target material.

The element holder 112 may comprise a handle 114, a raised annular rim 115, an annular sealing flange 127, and a central hole 128 for receiving the filter element 113. The peripheral edge of the filter element 113 may be secured to the edge of its hole 128. The rim 115 may be helpful in locating the element holder 112 in its hole 118 in the locking ring 49, and in holding extraction fluid in the vicinity of the filter element 113.

The size of the piston head 65's top plate 70 may be selected to be at least as large as the filter element 113, so that when the filter cartridge 13 is in the locking ring 49, the entire filter element 113 may rest directly on the top plate 70, in order to desirably enhance the transfer of vibrational energy from the top plate 70 to the filter element 113. This may also desirably enhance the extraction of particles of target material from the filter element 113. Alternatively, size of the piston head 65's top plate 70 may be selected to be larger than the filter element 113, so that when the filter cartridge 13 is in the locking ring 49, at least part of the filter element holder 112 may rest on the top plate 70, so that vibrational energy from the top plate 70 is indirectly transmitted to the filter element 113 through the element holder 112.

The Extraction Fluid

Any suitable extraction fluid may be used in the extractor 10. The particular extraction fluid selected may depend, for example, on the particular kind and size of the particles of target material that are to be extracted from the filter element 113, the composition, nature and structure of the filter media from which the filter element 113 is made, and the temperature of the filter element 113 and the extraction fluid.

In general, the extraction fluid may be selected to have one or more of the following properties. First, it should weaken or eliminate any bond between the particles of target material and the filter media making up the filter element 113, so that the particles of target material may be carried by the extraction fluid rather than remaining bonded to the filter media making up the filter element 113. Second, it should be compatible with whatever assay protocol may be selected to be used with a particular kind of particles of target material.

Third, it should have a low viscosity, to help enable particles of target material to move from the filter media making up the filter element 113 and into the extraction fluid, to become extracted particles of target material in the extraction fluid. Such movement may be, for example, through the Brownian motion of particles of target material that are of submicron size. The low viscosity may also help to provide good circulation of the extraction fluid within the filter media making up the filter element 113 while the filter element 113 is being subjected to vibration by the piston 55 during use of the extractor 10. Good circulation may help to redistribute the particles of target material more uniformly into the extraction fluid, and away from the internal structures of the filter media making up the filter element 113 that might otherwise impede movement of the particles of target material into the extraction fluid, or lead to their recapture during the extraction fluid discharge phase when using the extractor 10.

By way of example, if the filter media in the filter element 113 is made up of electret fibers, such as those described above, then the extraction fluid should weaken or eliminate the induced electrostatic bond between the surfaces of the electret fibers and the particles of target material. This requirement may be satisfied by an extraction fluid that comprises an alcohol-based or water-based solution that includes an amphiphilic surfactant such as Triton X-100, manufactured by J. T. Baker, Inc. of Phillipsburg, N.J. For example, such an extraction fluid may comprise a water-based phosphate buffered saline solution of pH 7.4, with 0.05% by weight of Triton X-100 surfactant.

In such an extraction fluid, the hydrophobic ends of the surfactant molecules bond to the hydrophobic surfaces of the electret fibers, while a respective cage of extraction fluid molecules, such as water molecules, surrounds each of the opposite ends of the surfactant molecules. Because of the high dielectric constant of water, these cages and any water films between the particles of target material and the surfaces of the electret fibers serve to electrostatically shield the particles of target material from those surfaces, thereby weakening the electrostatic bonds between those surfaces and the particles of target material.

Depending on the nature of the particular assay protocol that will be used for a particular kind of target material, the above example extraction fluid may be modified, as needed, so as to be compatible with that particular assay protocol. For example, if a standard wet bioassay protocol will be used, ionic salts such as sodium chloride may be added to the extraction fluid in an amount selected to achieve any desired assay-favorable or target material organism-favorable osmolarity. These ionic salts may also assist in weakening the electrostatic bonds between the particles of target material and the filter media making up the filter element 113.

Assembly and Use of the Extraction Device 10

The extraction device 10 may be assembled by first securing together its extractor body assembly 14 and its battery case assembly 15. This may be done in any suitable way, such as by securing the bottom 121 of the extractor body 51 to the top 122 of the battery case 100, and by securing the lower end of the bottle holder 86 to a side 123 of the battery case 100.

In order to use the extraction device 10 to extract collected particles of target material from a filter element 113, so that the particles of target material may be observed, tracked, monitored, examined, tested or analyzed, the filter cartridge 13 may first be placed in the locking ring 49 with its handle 114 and its rim 115 being received, respectively, by the handle recess 117 and the hole 118 of the locking ring 49. The filter cartridge 13 may be oriented and located in the locking ring 49 so that the "airside" of its filter element 113 faces, and may be in contact with, the top plate 70 of the piston 55.

By way of terminology, the "airside" face of the filter element 113 the side that faced the incoming sampled airflow that flowed through it while it was collecting particles of target material. Accordingly, its airside will normally have the highest concentration of the particles of target material collected from the sampled airflow.

Thus, by orienting the filter element 113 in the locking ring 49 so that its airside faces the top plate 70 of the piston 55, any undesirable re-entrapment of the particles of target material by the filter element 113 during use of the extraction device 10 will be minimized. This is because if the airside of the filter element 113 faced away from the top plate 70, then the filter element 113 would tend to re-entrap the particles of target material as they tried to migrate through the filter element 113 towards the inlet of the fluid discharge bore 69 in the top plate 70 during use of the extraction device 10.

In view of all of the disclosures herein, it is apparent that the extraction device 10 may be easily modified to be used with a filter cartridge 13 and filter element 113 of any size, shape and construction, and with a filter element 113 that is made from any kind of filter media, without departing from the scope and spirit of the claimed invention. Similarly, any particular filter cartridge 13 and filter element 113 may be easily modified to be used with an extraction device 10 having any particular desired physical construction. For example, depending on the size, shape and construction of a particular kind of filter cartridge 13 and filter element 113, and depending on the filter media from which the filter element 113 is made, some parts of that particular kind of filter cartridge 13 and filter element 113 may have to be removed or modified to enable that particular kind of filter cartridge 13 and filter element 113 to be used with the extraction device 10. In addition, a particular kind of filter element 113 may be removed from its filter cartridge 13 and modified in any suitable way, so that only the filter element 113, and not the entire filter cartridge 13, is placed in the hole 118 of the locking ring 49.

After the filter cartridge 13 has been placed in the locking ring 49, the pump cap assembly 12 may then be releasably secured to the extractor body assembly 14 by inserting the flange 21 of the pump cap 17 into its recess 124 in the locking ring 49, with its flange 21 being oriented so that the locking pins 22 on the flange 21 enter their respective central openings 130 of their respective locking dogs 50; and by then rotating the pump cap 17 clockwise until the locking pins 22 are received by their respective extraction recesses 131 in their respective locking dogs 50. At this time, the seal 25 on the neck 24 of the pump cap 17 may provide a fluid-tight seal between the neck 24 and the top of the annular sealing flange 127 of the filter element holder 112; while the annular free portion 81 of the diaphragm 54 may provide a fluid-tight seal between the bottom of the annular sealing flange 127 and the diaphragm 54. Alternatively, the filter element holder 112 may be eliminated, so that just the filter element 113 may be placed on top of the piston 55. In such a case, any suitable fluid-tight seal may be provided in any suitable way between the pump cap assembly 12 and the extractor body assembly 14.

Next, the cap 28 for the Luer fitting 27 may be unscrewed and removed, and a selected amount of any suitable extraction fluid may be added in any suitable way to the extraction chamber 129 through the Luer fitting 27 and through the bore 46 in the flange 21 of the pump cap 17 so that the filter element 113 contains extraction fluid. For example, the extraction fluid bottle 88 may be selected to have a size that is sufficient to hold the selected amount of extraction fluid, and may be conveniently used to add the extraction fluid by removing its cap 93, inserting its nipple 94 into the Luer fitting 27 and squeezing it until the selected amount of the extraction fluid has been added to the extraction chamber 129.

Because the outlet of the bore 46 is located beneath the piston 34 (when the piston 34 is in its return position as seen in FIG. 3), and is located above the filter element 113, the extraction fluid that was added to the extraction chamber 129 may then flow down, under the force of gravity, from the bore 46 onto the filter element 113, and wet it. Once the interior volume of the filter element 113 has been filled with extraction fluid (i.e., once the filter element 113 has been saturated with extraction fluid), any additional amount of extraction fluid that may have been added to the extraction chamber 129 may be retained over the filter element 113 by the raised rim 115 of its element holder 112 or by the locking ring 49.

It has been discovered that the minimum amount of extraction fluid required for good operation of the extraction device 10 may be as little as an amount that is equal to at least about one to at least about two times the uncompressed volume of the filter element 113. However, the amount of the extraction fluid that is used may be substantially greater than two times the uncompressed volume of the filter element 113.

After the extraction fluid has been added to the extraction chamber 129, the cap 28 may be replaced on the Luer fitting 27 to seal the Luer fitting 27. Alternatively, the extraction fluid may be derived from any suitable external source and delivered to extraction chamber 129 in any suitable way, such as via a tube connected to Luer fitting 27. In such case, cap 28 is not needed since the remote source and its tube will seal the Luer fitting 27 after an appropriate amount of extraction fluid has been transferred to the extraction chamber 129. The filter element 113 may be allowed to soak in the extraction fluid for any desired length of time, such as from about 5 to 30 seconds, or more. The selected amount of soaking time may vary, depending on such factors as, for example, the particular kind of extraction fluid being used, the particular kind of particles of target material that need to be extracted from the filter element 113, and the construction and materials from which a particular filter element 113 may be made.

Figure 4:
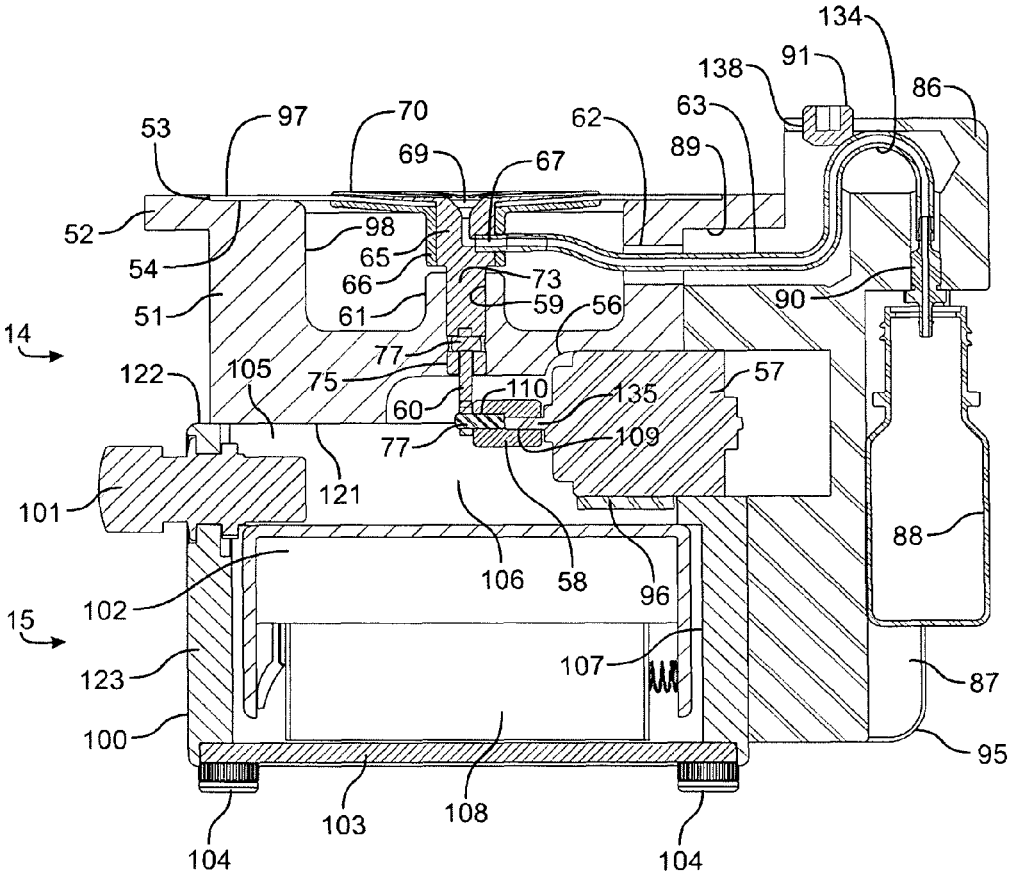
FIG. 4 is a cross-sectional view of the extraction device 10's extractor body assembly 14 (except for its locking ring 49 and dogs 50), battery case assembly 15, and bottle holder 86, taken along line 3-3 of FIG. 1.

The bottle 88's nipple 94 may then be removed, and the nipple 94 and cap 93 may then be conveniently stored by screwing the cap 93, with the nipple 94 inside, onto the bottle cap holder 92. The bottle cap holder 92 may provide the important dual functions of preventing the cap 93 and nipple 94 from being lost, and of keeping the nipple 94 and the interior of the cap 93 clean. The empty bottle 88 may then be slid or snapped into its slot 87 in the bottle holder 86, and then slid up its slot 87 until, as best seen in FIG. 4, the outlet end of the outlet fitting 90 is located in the open mouth of the bottle 88, and until the top of the open mouth touches the inside of the upper end of the slot 87, to help prevent any foreign matter in the environment from reaching the interior of the bottle 88. The bottle 88 may serve the dual functions of not only initially holding the desired amount of extraction fluid, but of also serving as the collection vessel for the extraction fluid (and for the extracted particles of target material that the extraction fluid contains) that are discharged from the extraction device 10 through its outlet fitting 90.

The switch 101 may then be turned on for any desired length of time, such as for about 10 to 30 seconds, or longer, to provide power to the vibration motor 57. The vibration motor 57 will then cause the entire piston 55, including its the top plate 70, to vibrate up and down. The top plate 70 will then, in turn, cause the filter element 113 (which rests on the top plate 70), and the filter element holder 112 (which rests on the annular free portion 81 of the piston 55's diaphragm 54), to also vibrate up and down. Alternatively, instead of using a manually operated on/off switch 101 to control power to the vibration motor 57, any suitable timing circuit may be used to automatically turn the vibration motor 57 on, and then off, after any desired amount of running time for the vibration motor 57, once a switch to the timing circuit has been momentarily pressed.

The selected amount of vibration time may vary, depending on such factors as, for example, the particular kind of extraction fluid being used, the particular kind of particles of target material that need to be extracted from the filter element 113, the construction of the filter element 113, the materials from which the filter element 113 may be made, and the power and frequency of the vibrations imparted to the filter element 113 by the vibration motor 57.

The vibrations imparted to the filter element 113 may desirably spread the extraction fluid throughout the filter element 113, and dislodge any bubbles that may have been trapped within the filter element 113 when the extraction fluid was added to it. Such vibrations may also move at least some of the collected particles of target material in the filter element 113 from the filter media in the filter element 113 and into the extraction fluid, to form a particle-laden extraction fluid. It is theorized that this separation of the particles of target material from the filter media may be due to: (a) the complex internal pressure fields created within the filter element 113 by the vibrations it experiences, which may tend to randomize the position of the particles of target material within it; and (b) the fact that the filter media in the filter element 113 and the extraction fluid may respond differently to the vibrations imparted to the filter element 113 because the filter media may be relatively stiff as compared to the mobility of the extraction fluid, resulting in a churning action of the extraction fluid within the filter media that helps to disengage the particles of target material from the filter media and disperse them into the extraction fluid.

During the vibration step, it may be preferred to maximize the amount of extraction fluid that stays in and around the filter element 113 (so that it can extract particles of target material from the filter element 113), by minimizing the amount of extraction fluid that leaves through the extraction fluid discharge bore 69 in the piston 55 during the vibration step. This may be done in any suitable way.

For example, as best seen in FIG. 4, the fluid discharge tube 63 may be formed into a P-trap 134 within the bottle holder 86. Since the highest part of the P-trap 134 is higher than the fluid discharge bore 69, once the portion of the fluid discharge tube 63 between the discharge bore 69 and the P-trap 134 has filled with extraction fluid, the P-trap 134 will prevent any more of the extraction fluid from exiting through the fluid discharge bore 69 during the vibration step. In any event, the amount of extraction fluid held by the portion of the fluid discharge tube 63 between the discharge bore 69 and the P-trap 134 may be minimal, since the discharge tube 63 may have an internal diameter of about 1 mm to 2 mm, although its internal diameter may be selected to be smaller or larger in size. As an alternative, any suitable valve, in any suitable location, that is operable to prevent, or minimize, loss of the extraction fluid through the fluid discharge bore 69 during the vibration step may replace the P-trap 134.

After the vibration step has been completed, the extraction step may then be taken. During the extraction step, the particle-laden extraction fluid is removed from the filter element 113 and placed into any suitable collection vessel, such as the bottle 88, so that the extracted particles of target material may be observed, tracked, monitored, identified, examined, tested or analyzed by the user.

Removal of particle-laden extraction fluid from the filter element 113 may be accomplished by using either compressed air or physical compression (i.e., squeezing) of the filter element 113, or both. The term "compressed air" is used broadly in this context, and includes any compressed gas, and any mixture of compressed gasses, whether or not that mixture of compressed gasses is air.

If the extraction chamber 129 contains compressed air, that compressed air may urge or drive particle-laden extraction fluid out of filter element 113 and into fluid discharge bore 69 of the piston 55. The part of the particle-laden extraction fluid that is driven out of the filter element 113 by the compressed air may be termed the "compressed air-extracted portion of the particle-laden extraction fluid". Any desired amount of compressed air for the extraction chamber 129 may be provided in any suitable way. For example, the compressed air may be provided by any suitable external compressed air source that is located outside of the extraction chamber 129, and may be introduced into the extraction chamber 129 in any suitable way, such as through the Luer fitting 27. Introducing the compressed air through the Luer fitting 27 may also provide a convenient way of helping to purge the Luer fitting 27 of any residual extraction fluid that may have remained in it after it has been previously used to introduce extraction fluid into the extraction chamber 129.

Physically compressing the filter element 113 in any suitable way, such as with the piston 34, will also urge or drive particle-laden extraction fluid out of filter element 113 and into the discharge bore 69. The part of the particle-laden extraction fluid that is driven out of the filter element 113 by the piston 34 physically compressing the filter element 113 may be termed the "piston-extracted portion of the particle-laden extraction fluid". However, it may be preferable to precede physical compression of the filter element 113 with a compressed air step to drive extraction fluid out of the filter element 113, since this will minimize contact of the piston 34 with the particle-laden extraction fluid in the filter element 113.

For a portable extraction device 10, it may be undesirable for it to have to rely on an external compressed air source. It has been discovered that even a single downward stroke of the piston 34 may be used to both provide compressed air for the extraction chamber 129, and to physically compress the filter element 113. This is because during the downward stroke of the piston 34, it will first compress the air in the extraction chamber 129 between it and the filter element 113, to force some of the particle-laden extraction fluid to flow out of the filter element 113 and into discharge bore 69. The piston 34 may then force an additional amount of the particle-laden extraction fluid out of the filter element 113 as it continues its downward travel and first contacts, and then fully compresses, the filter element 113 against the piston 55. The downward travel of the piston 34 may be stopped by the piston 55 whose downward travel may, in turn, be stopped by the stop 61 in the extractor body 51. The flexible link 60 allows the piston 55 to move downward toward the stop 61 without placing undue stress on the motor 57's shaft and bearings.

The above downward travel of the piston 34 in the extraction chamber 129 during its compression stroke may caused in any suitable way, such as by the user pressing down on the pump handle 29, which causes the pump shaft 30 and piston 34 to move downward. Similarly, upward movement of the pump shaft 30 and piston 34 on the piston 34's return stroke may also be caused in any suitable way, such as by return spring 31 or by the user pulling up on the pump handle 29. As an alternative to a hand operated piston 34, the extraction device 10 may comprise any suitable powered device for moving the pump shaft 30 and piston 34 up and down in the extraction chamber 129, such as any suitable pneumatic, hydraulic, electrical or other powered device.

It is noted that the extraction device 10 may have the following seals: (a) a seal between the piston 34 and the cylinder 26, that may be provided by the O-ring 37, (b) a seal between the cylinder body 19's neck 24 and the element holder 112's annular sealing flange 127, that may be provided by the seal 25; (c) a seal between the bottom of the annular sealing flange 127 and the annular free portion 81 of the diaphragm 84, that may be provided by the free portion 81; (d) a seal between the bottom of the locking ring 49 and the annular assembly edge 80 of the diaphragm 84, that may be provided by the edge 80; and (e) a seal between the bottom of the locking ring 49 and the extractor body 51's flange 52, that may be provided by the gasket 97 or by the edge 80.

As a result of the above seals, when the piston 34 travels down during its compression stroke, it compresses the air in the extraction chamber 129 beneath it. This compressed air may have two effects. First, it may urge the valve membrane 39 against the valve ports 36 in the piston 34, thereby preventing the compressed air in the extraction chamber 129 from escaping through the valve ports 36 during the piston 34's compression stroke.

Second, the compressed air may urge the particle-laden extraction fluid: (a) to flow out of the filter element 113; (b) to flow into the fluid discharge grooves 68 of the piston 55's top plate 70; (c) to flow into the inlet of the fluid discharge bore 69 in the top plate 70; and (d) to then flow out of the piston 55 and into the extraction fluid bottle 88 through the fluid discharge tube 63. If there were extra extraction fluid, in the sense that there was more extraction fluid in the extraction chamber 129 than could be held by the filter element 113, so that the extra extraction fluid formed a pool on top of the filter element 113, then the compressed air may first urge such extra extraction fluid to flow into the filter element 113 before the extra particle-laden extraction fluid followed the above flow sequence (a)-(d).

Since the top plate 70 may be concave, gravity may also urge the particle-laden extraction fluid to flow into the fluid discharge grooves 68 and into the inlet of the fluid discharge bore 69 in the top plate 70.

Any remaining particle-laden extraction fluid in the filter element 113 may then be mechanically removed from it by compressing it in the following way. Near the bottom of the piston 34's compression stroke, the filter compression pad 45 may first make contact with the filter element 113, and may then compress it against the top plate 70 of the piston 55 until it is compressed to, or near to, its minimum void volume at the end of the piston 34's compression stroke. The filter element 113's minimum void volume is the minimum volume that its compressed filter media will occupy when it has been compressed to the point that it can be compressed no further. At or near the filter element 113's minimum void volume the maximum amount of particle-laden extraction fluid will have been compressed out of it, aside from an unavoidable minimum amount of particle-laden extraction fluid that will remain in it, even after it has been compressed.

As it compresses the filter element 113, the filter compression pad 45 may urge the particle-laden extraction fluid: (a) to flow out of the filter element 113; (b) to flow into the fluid discharge grooves 68 of the piston 55's top plate 70; (c) to flow into the inlet of the fluid discharge bore 69 in the top plate 70; and (d) to then flow out of the piston 55 and into the extraction fluid bottle 88 through the fluid discharge tube 63.

Although it may be preferred to compress the filter element 113 until it is near, or at, its minimum void volume, it may be compressed less than this amount, or it may not be compressed at all by the filter compression pad 45.

Once the filter element 113 has been compressed to the desired degree, the pump handle 29 may be released, so that the return spring 31 may raise the piston 34 to its maximum return stroke position. Alternatively the spring 31 may be eliminated, and the piston 34 may be raised manually to its maximum return stroke position by pulling up on the pump handle 29.

When the piston 34 is traveling on its return stroke, it is apparent that the piston 34 may tend to create a partial vacuum within the extraction chamber 129 beneath it. This may not be desirable, since such a partial vacuum may tend to permit the higher ambient air pressure outside of the extraction chamber 129 to urge the discharged extraction fluid to flow back into the filter element 113 through the discharge tube 63 and discharge bore 69.

However, the valve membrane 39 and the valve ports 36 may relieve any partial vacuum tending to be created by the piston 34 on its return stroke because the higher air pressure above the valve ports 36 will push the valve membrane 39 away from the valve ports 36 in the piston 34, thereby permitting air above the piston 34 to enter the extraction chamber 129 beneath the piston 34 by traveling through the airflow space 42 between the valve membrane holder 40 and the piston 34, and through the airflow space 42 between the periphery of the valve membrane holder 40 and the inner surface of the cylinder 26.

Alternatively, any other suitable valve may be used with the piston 34 instead of the valve membrane 39 and valve ports 36. As a further alternative, back flow of the extraction fluid into the filter element 113 during the return stroke of the piston 34 may also be prevented in any other suitable way such as by providing any suitable check valve in any suitable location in the fluid path between the extraction fluid bottle 88 and the filter element 113.

The vent holes 20 in the cylinder body 19 may permit air to flow into the extraction chamber 129 above the piston 34 during its compression stroke, and may permit air above it to flow out of the extraction chamber 129 during its return stroke.

The above extraction step may be repeated as many times as desired, such as between two to ten times, or more, to help ensure that as much of the particle-laden extraction fluid as possible has been removed from the filter element 113 and discharged into the extraction fluid bottle 88.

Performing the extraction step at least a second time may be desirable. This is because, for example, repeated compressions of the filter element 113 may increase the amount of particle-laden extraction fluid that is removed from it. In addition, some particle-laden extraction fluid may remain in the fluid path between the filter element 113 and the extraction fluid bottle 88 after the first extraction step has been completed. Accordingly, if the extraction step is performed at least a second time, the compressed air produced beneath the piston 34 during the second extraction step may tend to urge any such remaining particle-laden extraction fluid out of that fluid path and into the bottle 88. Maximizing the amount of particle-laden extraction fluid collected by the bottle 88 may be very important, particularly if only small amounts of extraction fluid are used in the extraction device 10.

As an alternative, an additional amount of extraction fluid may be added to the extraction chamber 129 in the manner set forth above prior to performing one or more of the second, or subsequent, extraction steps, to further assist in removing as many of the particles of target material from the filter element 113 as possible.

After the particle-laden extraction fluid is in the extraction fluid bottle 88, the bottle 88 may be removed from the bottle holder 86; and its nipple 94 and cap 93 may then be replaced on it after being removed from the bottle cap holder 92.

To remove the used filter cartridge 13 from the extraction device 10 after the extraction fluid has been collected from it, the pump cap 17 is rotated counter clockwise until its locking pins 22 are under their respective central openings 130 in their respective dogs 50. The pump cap assembly 12 may then be lifted to remove it from the extractor body assembly 14, at which time the used filter cartridge 13 may be removed from the extractor body assembly 14.

The extraction device may be decontaminated, i.e., cleaned, in any suitable way once the used filter cartridge 13 has been removed from it. For example, the pump cap assembly 12 and the extractor body assembly 14 may be cleaned while they are separated from each other, by using any suitable cleaning and rinsing solutions in any suitable way to clean and rinse all of their surfaces that were exposed to the extraction fluid during use of the extraction device 10.

Alternatively, after the used filter cartridge 13 has been removed from the extraction device 10, the pump cap assembly 12 may be re-assembled to the extractor body assembly 14, and the pump cap 17 may then be rotated (counterclockwise) until its locking pins are engaged in their respective decontamination slots 132. The extraction device 10 may then be decontaminated in any suitable way, such as by adding any suitable cleaning and rinsing solutions to it, and by then operating the extraction device 10 as many times as desired in the manner previously described regarding its use with the extraction fluid.

Test Results

The following tests were conducted on a filter cartridge 13 having a circular filter element 113 about 43.6 mm in diameter and about 3.3 mm thick made from the above described G-100 electret, hydrophobic, fibrous bulk filter media made by the 3M company of St. Paul, Minn. Such a filter element 113 may be compressed considerably because the filter media from which it is made has a very low density, i.e., about 96% of its uncompressed volume comprises air spaces between the fibers in the filter media. The uncompressed volume of the filter element 113 was about 4.9 cc.

A first test was done in order determine the effect of using the extraction device 10 more than once on the same filter element 113, in a situation where a fresh volume of extraction fluid was used each time the extraction device 10 was used. To perform this test, a filter cartridge 13 was placed in a SASS 3000 Dry Air Sampler manufactured by Research International, Inc. of Monroe, Wash. and was used to collect test particles, comprising fluorescent polystyrene beads 1.8 microns in diameter, for a period of 10 minutes with the sampled airflow having a flow rate through the filter element 113 of about 300 liters per minute.

After the collection process was completed, the filter cartridge 13 was placed in an extraction device 10, which was then used as described above with 5 ml of extraction fluid to extract the test particles from the filter element 113. The extraction device 10's extraction efficiency (i.e., the percentage of the test particles in the filter element 113 that were extracted from the filter element 113 by the extraction device 10), was then determined using fluorimetric assay methods.

It was found that when only 5 ml of extraction fluid was used in the extraction device 10, the extraction device 10 recovered, on the average, about 77% of the test particles that had been collected by the filter element 113. Using the extraction device 10 a second time on the same filter element 113 with an additional 5 ml of extraction fluid resulted in recovery of about another 17% of the test particles that had been collected by the filter element 113; while using the extraction device 10 a third time and a fourth time with an additional 5 ml of extraction fluid each time resulted in additional recoveries of about 4.5% and 1.5%, respectively, of the test particles that had been collected by the filter element 113.

A second test was performed that was designed to study what effect the size of the test particles that were collected by the filter element 113 may have on the efficiency of the extraction device 10 being able to extract the test particles from the filter element 113. For this test series a water-based suspension of test particles comprising fluorescent polystyrene beads 0.9 to 15.0 microns diameter was spotted (deposited) uniformly over the airside of some new filter elements 113 and over the outlet side of some other new filter elements 113. The airside of a filter element 113 is its side that faces the incoming sampled airflow, while its outlet side is its side that faces away from the incoming sampled airflow. Each fluid spot had a volume of 10 μl.

For the filter elements 113 which had the suspension deposited on their airsides, a small amount of a surfactant was added to the water based suspension that was used for the spotting, because a dilute surfactant in the water based suspension assisted in wicking the water based suspension of test particles deep into the filter media making up the filter element 113.

For the filter elements 113 which had the suspension deposited on their outlet sides, only distilled water was used to create the water based suspension that was used for the spotting, because distilled water results in poor penetration of the water based suspension into the filter media making up the filter element 113, meaning that most of the suspended test particles ended up on or near the outer surface of the outlet side of the filter media. This provides a worst-case scenario for the positions of the test particles in the filter element 113 because the test particles must then travel through the entire thickness of the filter element 113 during use of the extraction device 10 because the filter element 113 is placed in the extraction device 10 with its outlet side up (i.e. facing away from the inlet of the fluid discharge bore 69 in the top plate of 70 of the piston 55).

After all of the spotted filter elements 113 had been allowed to air dry, the extraction device 10 was used to extract the test particles from each of the filter elements 113 by using 6 ml of any suitable extraction fluid, such as one of those described above.

Figure 14:
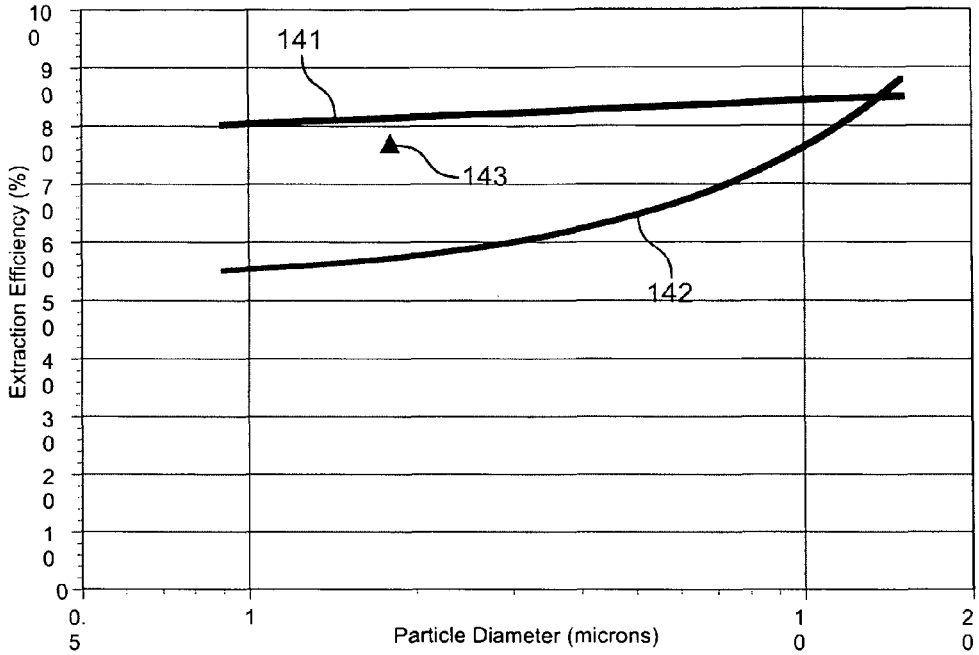
FIGS. 14 and 15 are graphs showing certain performance test results for an example extraction device 10.

In FIG. 14, curves 141, 142 show the extraction efficiency of the extraction device 10 for airside and outlet side deposits of the test particles on the filter elements 113, respectively. The data point 143 is for the results of the first test described above, in which the extraction device 10 was used once on a filter element 113 that had collected test particles that were 1.8 microns in diameter.

Curve 141 in FIG. 14 shows that the extraction efficiency of the extraction device 10 for test particles deposited on the airside of the filter element 113 is relatively independent of the size of the test particles, i.e. the extraction device is highly efficient at extracting test particles from the filter element 113, regardless of the size of the test particles. Data point 143 in FIG. 14 shows that the first test results described above when using 1.8-micron diameter test particles are very similar to the results shown in curve 141.

Curve 142 in FIG. 14 shows that the extraction efficiency of the extraction device 10 for test particles deposited on the outlet side of the filter element 113 noticeably improves as the size of the test particles increases, until the difference in extraction efficiency becomes insignificant between airside and outlet side deposition of the test particles, for test particles larger than about 10 microns.

Curve 142 may appear counterintuitive at first blush, since it might seem that larger test particles should have a harder time passing through the filter element 113, due to their larger size, than would smaller test particles. However, because the interstices between the fibers in the filter element 113 may be, on the average, much larger than 10-microns in size, relatively few of even 10-micron sized test particles are trapped between the fibers in the filter element 113 as the test particles are extracted from it by the extraction fluid.

It is theorized that curve 142 occurs because the electrostatic forces that bond larger test particles to the electret fibers in the filter element 113 may be about the same as those that bond smaller test particles; while, at the same time, larger test particles may be more heavily influenced by the fluid forces exerted on them by the extraction fluid in the filter element 113 than are smaller test particles, due to their greater surface area. As a result, such fluid forces can more easily overcome the electrostatic forces that bond larger test particles to the electret fibers, than they can the electrostatic forces that bond smaller test particles. This means that such fluid forces: (a) tend to release into the extraction fluid larger particles more easily than smaller particles; and (b) tend to prevent the electrostatic recapture of larger particles by the electret fibers more easily than smaller particles.

It is further theorized that curve 141, which shows that the extraction efficiency of the extraction device 10 for test particles deposited on the airside of the filter element 113 is relatively independent of the size of the test particles, results because all of the test particles deposited on the airside of the filter element 113 have a relatively short distance to travel before they are completely removed from the filter element 113 by the extraction fluid. As a result, the electrostatic recapture rate of the electret fibers for all sizes of test particles is relatively low.

Taken together, the data illustrated in FIG. 14 shows that under the above test conditions the extraction device 10 may be expected to extract at least about 60% to at least about 80%, or more, of the test particles that are initially collected by the filter element 113, regardless of the size of the test particles, and regardless of their initial location in the filter element 113.

In addition, even more of the test particles in the filter element 113 would be extracted from it if the extraction device 10 was used more than once on the filter element 113, since each repeated use of the extraction device 10 may be expected to extract additional test particles from the filter element 113.

A third test was performed that was designed to study what effect the volume (amount) of extraction fluid used in the extraction device 10 had on the efficiency of the extraction device 10 in extracting test particles from the filter element 113. For this test, a water based suspension of test particles comprised of 1.8 micron fluorescent polystyrene beads was prepared which had a small amount of a surfactant added to it. This suspension was used to spot (deposit) the test particles on the airside of several filter elements 113 in the manner described above. In these tests, the extraction device 10 was used only once to extract the test particles from each filter element 113.

Figure 15:
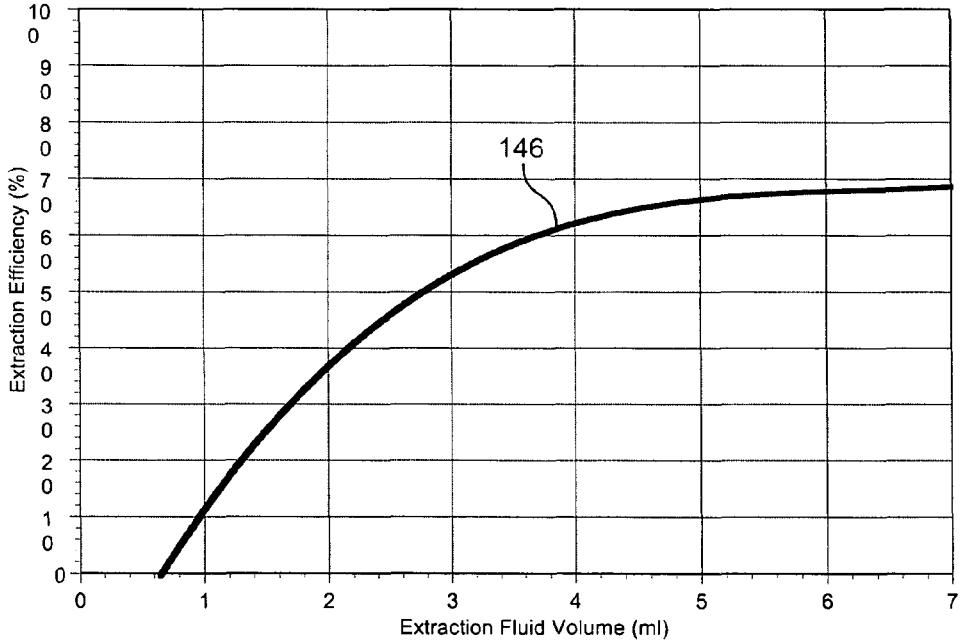

Curve 146 in FIG. 15 shows that the overall efficiency of a single use of the extraction device 10 in extracting the test particles from the filter element 113 is maximized if a minimum of about 5 ml of extraction fluid is used. As set forth above, the uncompressed volume of the filter element 113 is about 4.9 cc, which is equal to about 4.9 ml, since 1 ml is equal to one cc. If 5 ml of extraction fluid is used, then only about 4.35 ml of extraction fluid will actually be recovered in the extraction fluid bottle 88, since it is not possible to remove all of the extraction fluid from the filter element 113, even when it is fully compressed by the filter compression pad 45.

Accordingly it has been discovered that using a volume of extraction fluid that is as small as about the uncompressed volume of the filter element 113 will result in the extraction device 10 achieving very high extraction efficiencies for extracting particles of target material from the filter element 113, even if many of the particles of target material are initially trapped deeply within the filter element 113.

This is an important discovery because, in general, the smaller the volume of extraction fluid used, the higher will be the concentration of the particles of target material in that volume of extraction fluid. In turn, a higher concentration of particles of target material in the extraction fluid makes any subsequent observation, tracking, monitoring, identification; examination, testing or analysis of the extracted particles of target material more easily, more quickly, and more sensitively done than would otherwise be the case.

In addition, this discovery may be counterintuitive, since most people may intuit that the particles of target material would remain trapped between, and by, the fibers making up the filter element 113, making extraction of the particles from the filter element 113 extremely difficult and inefficient.

The comparatively high extraction efficiencies achieved by even a single use of the extraction device 10 to extract from a filter element 113 even those particles of target material that are initially located deeply within it may be the result of several features, such as: (a) using an effective extraction fluid, (b) using vibration to dislodge the particles of target material from all of the fibers of the filter element 113, (c) using both compressed air and mechanical compression of the filter element 113 to extract particle of target material from the filter element 113, and (d) regulating the direction of flow of the extraction fluid so that it enters the outlet side of the filter element 113 and exits through the airside of the filter element 113, where the concentration of the particles of target material that were collected by the filter element 113 is the greatest.

It is to be understood that, without departing from the scope and spirit of the claimed invention, any particular part of the extraction device 10 may be suitably combined or formed with one or more of its other parts to form one integral or composite part; that any particular part of the extraction device 10 that may be made in one piece may instead be made by assembling together in any suitable way, two or more sub-pieces; and that the various parts of the extraction device 10 may be assembled together in any suitable ways other than those described herein, such by using fasteners; interference fits, friction fits; barbed, threaded, bonded, glued or welded connections; splines; keys; or mechanical couplers.

It is also to be understood that the specific embodiments of the claimed invention that are disclosed herein were disclosed strictly by way of non-limiting example. Accordingly, various modifications may be made to those embodiments without deviating from the scope and spirit of the claimed invention. Additionally, certain aspects of the claimed invention that were described in the context of a particular embodiment may be combined or eliminated in other embodiments. Although advantages associated with a certain embodiment of the claimed invention have been described in the context of that embodiment, other of the embodiments may also exhibit such advantages. Further, not all embodiments need necessarily exhibit any or all of such advantages in order to fall within the scope of the claimed invention.

When the phrase "at least one of" is used in any of the claims, that phrase is defined to mean that any one, any more than one, or all, of the listed things or steps following that phrase is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, and/or all of A, B and C.

Before an element in a claim is construed as claiming a means for performing a specified function under 35 USC section 112, last paragraph, the words "means for" must be used in conjunction with that element.

As used herein, except in the claims, the words "and" and "or" are each defined to also carry the meaning of "and/or".

In view of all of the disclosures herein, these and further modifications, adaptations and variations of the claimed invention will now be apparent to those of ordinary skill in the art to which it pertains, within the scope of the following claims.

What is claimed is:

1. For a filter element holding collected particles, a method for extracting at least some of said collected particles from said filter element; wherein said method comprises the steps of:

(1.a) providing an extraction device comprising an extraction chamber, a discharge bore for said extraction chamber, a piston in said extraction chamber, and a filter support for said filter element; wherein said filter support is located in said extraction chamber;

(1.b) placing said filter element on said filter support; wherein a portion of said extraction chamber between said piston and said filter element on said filter support is operable to contain compressed air, wherein said compressed air can be compressed with said piston;

(1.c) adding an extraction liquid to at least one of said extraction chamber and said filter element;

(1.d) forming a particle-laden extraction liquid by vibrating said filter element an amount sufficient for moving at least some of said collected particles from said filter element and into said extraction liquid;

(1.e) after finishing step (1.d), using said piston for forming a compression-extracted portion of said particle-laden extraction liquid by compressing said filter element against said filter support an amount sufficient for urging out of said filter element at least some of said particle-laden extraction liquid; and (1.f) using said discharge bore for conveying at least part of said compression-extracted portion of said particle-laden extraction liquid out of said extraction chamber.

2. The method of claim 1, wherein said method further comprises the step of performing step (1.b) prior to performing step (1.c).

3. The method of claim 1, wherein said method further comprises the step of:

(4.a) performing step (1.e) by using said piston, during a compression stroke of said piston, for forming said compression-extracted portion of said particle-laden extraction liquid by compressing said filter element against said filter support an amount sufficient for urging out of said filter element at least some of said particle-laden extraction liquid.

4. The method of claim 1, wherein said method further comprises the steps of:

(5.a) forming a compressed air-extracted portion of said particle-laden extraction liquid by using said compressed air for urging out of said filter element at least some of said particle-laden extraction liquid; and (5.b) using said discharge bore for conveying at least part of said compressed air-extracted portion of said particle laden extraction liquid out of said extraction chamber.

5. The method of claim 4, wherein said method further comprises the step of:

(6.a) providing said compressed air from a compressed air source that is located outside of said extraction chamber.

6. The method of claim 5, wherein said method further comprises the step of performing step (6.a) prior to performing step (1.e).

7. The method of claim 4, wherein said method further comprises the steps of:

(9.a) locating an amount of air in said extraction chamber between said piston and said filter element; and (9.b) providing said compressed air by using said piston for compressing said amount of air during a compression stroke of said piston.

8. The method of claim 7, wherein said method further comprises the step of performing steps (9.a) and (9.b) prior to performing step (1.e).

9. The method of claim 1, wherein said method further comprises the step of vibrating both said filter element and said filter support during step (1.d).

10. The method of claim 1, wherein said method further comprises the steps of:

(12.a) providing a selectively sealable entry port for said extraction chamber; and (12.b) performing step (1.c) by using said selectively sealable entry port for adding said extraction liquid to at least one of said extraction chamber and said filter element.

11. The method of claim 1, wherein said method further comprises the steps of:

(13.a) providing said filter element with an airside; wherein at least some of said collected particles are located on said airside of said filter element;

(13.b) placing said filter element on said filter support with said airside facing said filter support while performing step (1.b); and (13.c) locating at least part of said discharge bore in said filter support.

12. The method of claim 1, wherein said filter element has an uncompressed volume;

wherein said extraction liquid has a volume; and wherein said method further comprises the step of selecting said volume of said extraction liquid while performing step (1.c) to be about equal to said uncompressed volume of said filter element.

13. The method of claim 1, wherein said filter element has an uncompressed volume; wherein said extraction liquid has a volume; and wherein said method further comprises the step of selecting said volume of said extraction liquid prior while performing step (1.c) to be in a range of from at least about 1 times to at least about 2 times said uncompressed volume of said filter element.

14. The method of claim 7, wherein said method further comprises the steps of:

(16.a) providing said piston with an air pressure actuated one-way valve;

(16.b) using said valve for enabling said piston to be operable for providing said compressed air while performing step (9.b) by using said piston for compressing said amount of air during said compression stroke of said piston, and (16.c) using said one-way valve for admitting said amount of air into said extraction chamber between said piston and said filter element during a return stroke of said piston.

15. The method of claim 1, wherein said method further comprises the step of selecting said filter element to comprise an electret filter media.

16. The method of claim 1, wherein said method further comprises the steps of:

(18.a) providing said extraction device with an extraction liquid discharge tube that is operable for connecting to said discharge bore;

(18.b) using said extraction liquid discharge tube for conveying at least some of said particle-laden extraction liquid away from said discharge bore; and (18.c) providing said extraction liquid discharge tube with a P-trap.

17. The method of claim 1, wherein said method further comprises the steps of:

(19.a) providing said extraction device with an extraction liquid bottle;

(19.b) selecting said extraction liquid bottle to be operable for holding a selected volume of said extraction liquid for use in said extraction device while performing step (1.c);

(19.c) providing said extraction device with an extraction liquid discharge tube that is operable for connecting to said discharge bore, and that is further operable for conveying at least some of said particle-laden extraction liquid away from said discharge bore; and (19.d) selecting said extraction liquid bottle to be operable for receiving from said extraction liquid discharge tube at least some of said particle-laden extraction liquid.

18. The method of claim 1, wherein said method further comprises the steps of:

(20.a) providing said extraction device with an extraction liquid bottle;

(20.b) selecting said extraction liquid bottle to be operable for holding a selected volume of said extraction liquid for use in said extraction device while performing step (1.c);

(20.c) providing a selectively sealable entry port for said extraction chamber; and (20.d) performing step (1.c) by using said selectively sealable entry port for adding at least some of said selected volume of said extraction liquid that is held by said extraction liquid bottle to at least one of said extraction chamber and said filter element.

19. The method of claim 17, wherein said method further comprises the steps of:

(21.a) providing a bottle holder for said extraction device; and (21.b) selecting said bottle holder to be operable for releasably holding said extraction liquid bottle in a position selected for enabling said extraction liquid bottle to be operable for receiving from said extraction liquid discharge tube at least some of said particle-laden extraction liquid.

20. The method of claim 19, wherein said method further comprises the steps of:

(22.a) providing said bottle holder with a pair of bottle flanges and a bottle slot;

(22.b) selecting said bottle flanges and said bottle slot to be operable for holding said extraction liquid bottle with a fit; and (22.c) selecting said fit to be operable for permitting said extraction liquid bottle to be slid back and forth in said bottle slot.

21. The method of claim 17, wherein said method further comprises the steps of:

(23.a) providing said extraction liquid bottle with a cap;

(23.b) providing said extraction device with a cap holder; and (23.c) selecting said cap holder to be operable for holding said cap, for helping keep said cap clean during use of said extraction device.

22. The method of claim 1, wherein said method further comprises the steps of:

(24.a) providing said extraction device with a stop for said piston;

(24.b) selecting said stop to be operable for preventing said piston from traveling past a predetermined range of travel during a compression stroke of said piston.

23. The method of claim 1, wherein said method further comprises the steps of:

(25.a) providing said extraction device with an extractor housing;

(25.b) locating said extraction chamber in said extractor housing;

(25.c) providing said extractor housing with a pump cap; an extractor body; a locking pin carried by one of said pump cap and said extractor body; and a locking dog carried by the other of said pump cap and said extractor body;

(25.d) providing said locking dog with an extraction slot for said locking pin;

(25.e) selecting said extraction slot to be operable for permitting said pump cap to be held in a first position with respect to said extractor body;

(25.f) providing said locking dog with a decontamination slot for said locking pin; and (25.g) selecting said decontamination slot to be operable for permitting said pump cap to be held in a second position with respect to said extractor body.

24. For a filter element holding collected particles, a method for extracting at least some of said collected particle from said filter element, wherein said method comprises the steps of:

(26.a) providing an extraction device comprising an extraction chamber, a piston in said extraction chamber, and a filter support for said filter element; wherein said filter support is located in said extraction chamber;

(26.b) placing said filter element on said filter support; wherein a portion of said extraction chamber between said piston and said filter element on said filter support is operable to contain compressed air, wherein said compressed air can be compressed with said piston;

(26.c) adding an extraction liquid to said filter element;

(26.d) forming a particle-laden extraction liquid by vibrating said filter element an amount sufficient to cause at least some of said collected particles to move from said filter element and into said extraction liquid.

(26.e) after finishing step (26.d), using said piston for forming a compression-extracted portion of said particle-laden extraction liquid by compressing said filter element against a surface an amount sufficient to urge out of said filter element at least some of said particle-laden extraction liquid; and (26.f) collecting at least part of said compression-extracted portion of said particle-laden extraction liquid.

25. The method of claim 24, wherein said method further comprises the steps of:

(27.a) providing said compressed air;

(27.b) forming a compressed air-extracted portion of said particle-laden extraction liquid by using said compressed air to urge out of said filter element at least some of said particle-laden extraction liquid; and (27.c) collecting at least part of said compressed air-extracted portion of said particle-laden extraction liquid.

26. The method of claim 25, wherein said method further comprises the step of performing step (27.b) prior to performing step (26.e).

* * * * *